US010058768B2

(12) United States Patent
Chun

(10) Patent No.: US 10,058,768 B2
(45) Date of Patent: Aug. 28, 2018

(54) AUTOMATED PLAYING CARD RETRIEVAL SYSTEM

(71) Applicant: Fresh Idea Global Limited, Hong Kong (HK)

(72) Inventor: Jay Chun, Hong Kong (HK)

(73) Assignee: Fresh Idea Global Limited, Hong Kong (HK)

( * ) Notice: Subject to any disclaimer, the term of this patent is extended or adjusted under 35 U.S.C. 154(b) by 0 days.

(21) Appl. No.: 15/691,738

(22) Filed: Aug. 30, 2017

(65) Prior Publication Data

US 2017/0361208 A1 Dec. 21, 2017

Related U.S. Application Data

(62) Division of application No. 14/692,623, filed on Apr. 21, 2015.

(51) Int. Cl.
*A63F 1/10* (2006.01)
*A63F 1/06* (2006.01)
(Continued)

(52) U.S. Cl.
CPC ..... *A63F 1/067* (2013.01); *A63F 1/00* (2013.01); *A63F 1/18* (2013.01); *A63F 3/00157* (2013.01);
(Continued)

(58) Field of Classification Search
CPC .... A63F 3/00157; A63F 3/00164; A63F 1/12; A63F 1/14; A63F 1/10; A63F 1/0167;
(Continued)

(56) References Cited

U.S. PATENT DOCUMENTS 5,083,271 A 1/1992 Thacher et al.
5,347,061 A 9/1994 Harandi et al.
(Continued)

FOREIGN PATENT DOCUMENTS

CN 101244335 8/2008
CN 101513571 8/2009
(Continued)

OTHER PUBLICATIONS

Office Action for U.S. Appl. No. 13/948,101, dated Dec. 16, 2013.
(Continued)

*Primary Examiner* — Benjamin Layno

(57) ABSTRACT

An automated playing card retrieval system is used with a physical gaming table that hosts live wager-based games. The system includes a movable receiving component that receives dealt physical playing cards and an automated card removal component that removes the cards to a discard region after the game. The movable receiving component can be a mechanized tray, can display card(s) to player(s) seated away from the table during game play, and can receive cards at a first position, move to a second position where cards are removed, and move to a third position where cards are displayed at a position elevated from and at a substantially non-parallel angle to the table surface. Additional system components can include an automated card return component that returns cards to another location for a future game, a robotic dealer, an automated card shuffler, a card shoe, and/or the table itself.

19 Claims, 10 Drawing Sheets

(51) Int. Cl.

| | |
|---|---|
| ***A63F 3/00*** | (2006.01) |
| ***A63F 1/18*** | (2006.01) |
| ***A63F 1/00*** | (2006.01) |
| *G07F 17/32* | (2006.01) |
| *A63F 1/12* | (2006.01) |
| *A63F 1/14* | (2006.01) |
| *A63F 9/24* | (2006.01) |

(52) U.S. Cl.
CPC . *A63F 1/10* (2013.01); *A63F 1/12* (2013.01); *A63F 1/14* (2013.01); *A63F 2003/00164* (2013.01); *A63F 2009/246* (2013.01); *A63F 2009/2458* (2013.01); *G07F 17/322* (2013.01); *G07F 17/3293* (2013.01)

(58) Field of Classification Search
CPC ... A63F 2003/00164; A63F 2003/0167; G07F 17/322; G07F 17/3293
USPC ..... 273/150, 148 A, 149 R, 149 P; 463/36, 463/47, 37
See application file for complete search history.

(56) References Cited

U.S. PATENT DOCUMENTS 5,472,194 A 12/1995 Breeding et al.
5,605,334 A 2/1997 McCrea
5,768,382 A 6/1998 Schneier et al.
5,823,873 A 10/1998 Moody
5,851,011 A 12/1998 Lott
5,917,725 A 6/1999 Thacher et al.
5,970,143 A 10/1999 Schneier et al.
6,165,069 A 12/2000 Sines et al.
6,331,148 B1 12/2001 Krause
6,361,044 B1 * 3/2002 Block ..... A63F 1/14 273/148 R
6,508,709 B1 1/2003 Karmarkar
6,671,358 B1 12/2003 Seidman et al.
6,886,829 B2 5/2005 Hessing et al.
6,991,544 B2 1/2006 Soltys et al.
7,008,322 B1 3/2006 Suzuki et al.
7,040,982 B1 5/2006 Jarvis
7,206,762 B2 4/2007 Sireau
7,233,922 B2 6/2007 Asher
7,553,233 B2 6/2009 Jarvis et al.
7,566,268 B2 7/2009 Asher
7,566,270 B2 7/2009 Amaitis
7,604,537 B2 10/2009 Amaitis
7,637,506 B2 12/2009 Naicker
7,684,874 B2 3/2010 Schlottmann et al.
7,690,996 B2 4/2010 Iddings et al.
7,711,628 B2 5/2010 Davie
7,727,060 B2 6/2010 Mills
7,731,586 B2 6/2010 Letovsky et al.
7,783,542 B2 8/2010 Horowitz
7,783,552 B2 8/2010 Assia
7,798,895 B2 9/2010 Jubinville et al.
8,052,526 B2 11/2011 Abbott et al.
8,070,583 B2 12/2011 Baerlocher et al.
8,150,157 B2 4/2012 Downs et al.
8,257,166 B2 9/2012 Kido
8,262,090 B2 9/2012 Soltys et al.
8,272,892 B2 9/2012 McNeely et al.
8,282,489 B2 10/2012 Azerina et al.
8,469,788 B2 6/2013 Carpenter et al.
8,590,895 B2 * 11/2013 Kwon ..... A63F 1/14 273/148 R
8,808,077 B1 8/2014 Chun
8,920,229 B1 12/2014 Chun
9,292,996 B2 3/2016 Davis et al.
9,311,773 B2 4/2016 Chung
9,592,450 B2 3/2017 Chun
9,595,166 B2 3/2017 Chun
2002/0094869 A1 7/2002 Harkham
2002/0147042 A1 10/2002 Shinners et al.
2002/0151366 A1 10/2002 Walker et al.
2003/0137110 A1 7/2003 Huard et al.
2003/0195841 A1 10/2003 Ginsberg
2004/0121839 A1 6/2004 Web
2004/0204232 A1 10/2004 Asher
2005/0043094 A1 2/2005 Nguyen et al.
2005/0165669 A1 7/2005 Montanaro
2005/0197938 A1 9/2005 Davie
2005/0197948 A1 9/2005 Davie
2006/0058082 A1 3/2006 Crawford et al.
2006/0058083 A1 3/2006 Crawford et al.
2006/0058084 A1 3/2006 Crawford et al.
2006/0058085 A1 3/2006 White et al.
2006/0058086 A1 3/2006 White et al.
2006/0058087 A1 3/2006 White et al.
2006/0058088 A1 3/2006 Crawford et al.
2006/0058089 A1 3/2006 White et al.
2006/0058090 A1 3/2006 Crawford et al.
2006/0058091 A1 3/2006 Crawford et al.
2006/0058092 A1 3/2006 Crawford et al.
2006/0058093 A1 3/2006 White et al.
2006/0066052 A1 3/2006 White et al.
2006/0068498 A1 3/2006 White et al.
2006/0068864 A1 3/2006 White et al.
2006/0068865 A1 3/2006 White et al.
2006/0068866 A1 3/2006 White et al.
2006/0068868 A1 3/2006 Crawford et al.
2006/0068869 A1 3/2006 White et al.
2006/0068870 A1 3/2006 Crawford et al.
2006/0068871 A1 3/2006 Crawford et al.
2006/0068879 A1 3/2006 Crawford et al.
2006/0068899 A1 3/2006 White et al.
2006/0094493 A1 5/2006 Kido
2006/0100019 A1 5/2006 Hornik et al.
2006/0105839 A1 5/2006 Graeve
2006/0217199 A1 9/2006 Adcox et al.
2006/0264252 A1 11/2006 White et al.
2006/0287066 A1 12/2006 Crawford et al.
2006/0287067 A1 12/2006 White et al.
2006/0287101 A1 12/2006 Crawford et al.
2006/0287102 A1 12/2006 White et al.
2006/0287103 A1 12/2006 Crawford et al.
2006/0287104 A1 12/2006 White et al.
2007/0015583 A1 1/2007 Tran
2007/0032283 A1 2/2007 Chun
2007/0060259 A1 3/2007 Pececnik
2007/0087832 A1 4/2007 Abbott et al.
2007/0090595 A1 * 4/2007 Csikos ..... A63F 1/06 273/149 R
2007/0129138 A1 6/2007 Amaitis
2007/0178955 A1 8/2007 Mills
2007/0259709 A1 11/2007 Kelly et al.
2008/0045344 A1 2/2008 Schlottmann et al.
2008/0081685 A1 4/2008 Naftaly
2008/0102916 A1 5/2008 Kovacs
2008/0108404 A1 5/2008 Iddings et al.
2008/0113767 A1 5/2008 Nguyen et al.
2008/0200242 A1 8/2008 Ginsberg
2008/0248849 A1 10/2008 Lutnick et al.
2008/0248864 A1 10/2008 Toyoda
2009/0005165 A1 1/2009 Arezina
2009/0121434 A1 5/2009 Baerlocher
2009/0124323 A1 5/2009 Dunn et al.
2009/0131151 A1 5/2009 Harris et al.
2009/0280904 A1 11/2009 Nicely et al.
2009/0291762 A1 11/2009 Walter
2009/0325686 A1 12/2009 Davis et al.
2010/0087241 A1 4/2010 Nguyen et al.
2010/0150460 A1 4/2010 Makhoul et al.
2010/0234099 A1 9/2010 Rasmussen
2010/0331085 A1 * 12/2010 Nagano ..... G07F 17/3211 463/31
2011/0111833 A1 5/2011 Nordahl
2011/0294561 A1 12/2011 Shaw et al.
2011/0300917 A1 12/2011 Hill
2012/0049447 A1 3/2012 Klein
2012/0049455 A1 3/2012 Yap et al.
2012/0083909 A1 4/2012 Carpenter et al.

(56) References Cited

U.S. PATENT DOCUMENTS

| | | | |
|---|---|---|---|
| 2012/0214575 | A1 | 8/2012 | Amaitis et al. |
| 2012/0252564 | A1 | 10/2012 | Moore et al. |
| 2012/0329551 | A1 | 12/2012 | Arerina et al. |
| 2013/0005456 | A1 | 1/2013 | Okujo et al. |
| 2013/0079147 | A1 | 3/2013 | Merati |
| 2013/0116031 | A1 | 5/2013 | Carpenter et al. |
| 2013/0134672 | A1 | 5/2013 | Okuaki |
| 2013/0225276 | A1 | 8/2013 | Au-Yeung |
| 2013/0244765 | A1 | 9/2013 | Arnone et al. |
| 2013/0281197 | A1 | 10/2013 | Carpenter et al. |
| 2013/0288764 | A1 | 10/2013 | Chun |
| 2013/0288779 | A1 | 10/2013 | Chun |
| 2013/0296031 | A1 | 11/2013 | Arnone et al. |
| 2013/0341862 | A1 | 12/2013 | Tokue |
| 2014/0187306 | A1 | 7/2014 | Nordahl |
| 2014/0256392 | A1 | 9/2014 | Jones |
| 2014/0274252 | A1 | 9/2014 | Chun |
| 2014/0274253 | A1 | 9/2014 | Chun |
| 2014/0312567 | A1 | 10/2014 | Chun |
| 2015/0024818 | A1 | 1/2015 | Chun |
| 2015/0332552 | A1 | 11/2015 | Chun |
| 2016/0292954 | A1 | 10/2016 | Sugai et al. |
| 2016/0310831 | A1* | 10/2016 | Chun ..... A63F 1/067 |
| 2017/0161988 | A1 | 6/2017 | Nguyen |
| 2017/0161993 | A1 | 6/2017 | Nguyen |

FOREIGN PATENT DOCUMENTS

| | | | |
|---|---|---|---|
| CN | 102580306 | | 7/2012 |
| EP | 1939826 | A2 | 7/2008 |
| TW | 201138907 | A1 | 11/2011 |

OTHER PUBLICATIONS

Cantor Fitzgerald Hopes to Bring Spread Betting to Las Vegas Casinos, Dec. 14, 2009.
Finanical Spread Betting, Apr. 26, 2012.
High-Speed Traders Set Their Sights on Asia and Latin America, Aug. 12, 2010.
Office Action for U.S. Appl. No. 13/456,110, dated Jun. 11, 2013.
Final Office Action for U.S. Appl. No. 13/456,110, dated Dec. 24, 2013.
Office Action for U.S. Appl. No. 14/017,071, dated Nov. 7, 2013.
Notice of Allowance for U.S. Appl. No. 14/017,071, dated Jan. 24, 2014.
Office Action for U.S. Appl. No. 14/017,073, dated Dec. 10, 2013.
Final Office Action for U.S. Appl. No. 13/948,101, dated Apr. 23, 2014.
Notice of Allowance for U.S. Appl. No. 14/017,073, dated May 20, 2014.
Office Action for U.S. Appl. No. 14/095,882, dated Aug. 14, 2014.
Office Action for U.S. Appl. No. 13/456,110, dated Sep. 12, 2014.
Office Action for U.S. Appl. No. 13/542,446, dated Sep. 10, 2014.
Office Action for U.S. Appl. No. 14/197,683, dated Aug. 4, 2014.
Office Action for U.S. Appl. No. 14/174,701, dated Mar. 12, 2015.
Final Office Action for U.S. Appl. No. 13/542,446, dated Mar. 25, 2015.
Final Office Action for U.S. Appl. No. 13/456,110, dated Apr. 22, 2015.
Office Action for U.S. Appl. No. 13/456,110, dated Jan. 13, 2016.
Final Office Action for U.S. Appl. No. 13/542,446, dated Jan. 4, 2016.
Office Action for U.S. Appl. No. 15/094,827, dated Sep. 22, 2016.
Notice of Allowance for U.S. Appl. No. 13/456,110, dated Nov. 16, 2016.
Notice of Allowance for U.S. Appl. No. 13/542,446, dated Nov. 16, 2016.
Office Action for U.S. Appl. No. 14/692,623, dated Oct. 5, 2016.
Office Action for U.S. Appl. No. 14/318,426, dated Sep. 11, 2015.
Notice of Allowance for U.S. Appl. No. 14/318,426, dated Dec. 8, 2015.
Office Action for U.S. Appl. No. 14/508,922, dated Jan. 30, 2017.
Final Office Action for U.S. Appl. No. 14/692,623, dated Mar. 24, 2017.
Notice of Allowance for U.S. Appl. No. 14/692,623, dated Jun. 30, 2017.
Restriction Requirement for U.S. Appl. No. 14/692,623, dated Sep. 6, 2016.
Office Action for U.S. Appl. No. 15/094,827, dated Sep. 13, 2017.
SIPO of People's Republic of China, Examiner's Report and International Search Report for Macau Patent Application No. I-1385 dated May 26, 2017(with partial Translation).
Notice of Allowance for U.S. Appl. No. 14/692,623, dated Nov. 29, 2017.

* cited by examiner

AUTOMATED PLAYING CARD RETRIEVAL SYSTEM

NOTICE OF RELATED APPLICATION

This application is a divisional application of U.S. patent application Ser. No. 14/692,623, now U.S. Pat. No. 9,931,562, which application is incorporated herein by reference in its entirety and for all purposes.

TECHNICAL FIELD

The present invention relates generally to gaming machines, tables and systems, and more particularly to physical gaming tables having automated components.

BACKGROUND

Wagering games such as baccarat, blackjack, roulette, craps, sic-bo, and various poker-based table games, among many others, are popular games offered in casinos and other similar establishments. These games are generally administered by human dealers and are played on physical gaming tables having a dealer surface, felt or similar table top layouts, cards, dice, chips and the like. Alternatively, such table games can be played on electronic gaming machines where the dealer, playing cards, chips or other gaming elements may be virtual.

It is generally well known that casinos and other gaming operators are often looking for ways to streamline game play, increase the number of hands per table for a given time period, and reduce overall errors and other issues that can lead to a loss of revenue. Furthermore, many experienced players also appreciate the ability to play games at an increased pace and free of errors or problems.

As a particular example, the implementation of "stadium style gaming" has introduced the ability of many multiples of players to play table games at the same physical gaming table, such as through the use of remotely located gaming terminals. In some such instances, dozens or hundreds of players can wager and participate in the same game at a physical gaming table. In addition, some operators have experimented with the idea of utilizing robotic dealers, which can theoretically minimize dealer slowness, error, and labor costs. These and other ways of automating or streamlining gameplay can be troublesome or incomplete, however, as there are still needs for verifying game play, game outcomes, player wagers and payouts, and the return or manipulation of physical playing cards and other physical game play components.

While gaming tables and systems therefor have worked well in practice over many years, there is always a desire improve the functionality and efficiency of gaming tables and the various physical gaming components therefor. What is desired then are improved gaming tables and components therefor, particularly with respect to the ability to provide more automated and streamlined game play.

SUMMARY

It is an advantage of the present disclosure to provide improved gaming tables and systems and components therefor, particularly with respect to those having physical gaming components such as cards, dice, balls, chips, tokens, and the like. In particular, it is an advantage of the present disclosure to provide gaming table systems that permit more automated and streamlined game play. As such, the disclosed automated playing card dealing and/or retrieval systems can provide for a more robust automation of the entire playing card dealing, gaming, and retrieval process. This can even reach the level of recycling playing cards in continuous automated game play, which might be for a fully automated administration of table games that are playable by players who are located remotely from the gaming table. This can be accomplished at least in part through the use of a movable receiving component, such as a mechanized tray, which can be used to receive, display, and dispose of dealt playing cards during an automated game process.

In various embodiments of the present disclosure, an automated playing card retrieval system adapted for use with a physical gaming table adapted to host live wager-based table games can include at least a movable receiving component and an automated card removal component, among other possible components. The movable receiving component can be adapted to receive one or more physical playing cards while or after those cards are dealt for the play of a live wager-based table game at a physical gaming table. This movable receiving component can be further adapted to display at least one of the playing cards to one or more players seated away from the physical gaming table during the play of the game. Also, the automated card removal component can facilitate the removal of the playing card(s) from the movable receiving component to a discard region after the play of the live wager-based table game involving the playing card(s).

In various detailed embodiments, the movable receiving component can include or be a mechanized tray. Further, the movable receiving component can be adapted to receive playing cards at a first position, and can also be adapted to be moved to a second position where the playing cards are removed to the discard region. The movable receiving component can be further adapted to display the playing cards at a third position that is separate from the first and second positions, such as wherein the playing cards are elevated from and held at a substantially non-parallel angle to the surface of the physical gaming table for such a display. Alternatively, or in addition, the display of the playing cards can be facilitated by the use of one or more cameras adapted to send images of the playing cards to one or more remotely located gaming terminals. Further, the automated card removal component can be adapted to manipulate the movable receiving component such that the playing cards are removed therefrom. In addition, the one or more physical playing cards can be all of the playing cards used for the play of the live wager-based table game.

In various further detailed embodiments, which can include one, some, or all of the foregoing detailed embodiments or features, the automated playing card retrieval system can further include an automated card return component that is adapted to facilitate the return of the one or more physical playing cards from the discard region to another location where the cards can be processed for the play of a future live wager-based table game at the physical gaming table. The playing cards can be dealt from a card shoe at the physical gaming table, and the automated card return component can be further adapted to facilitate the return of the physical playing cards to the card shoe. In addition, the playing cards can be processed by an automatic card shuffler before being returned to the card shoe. In various embodiments, the automated card return component can include a conveyor, can include an air blower or vacuum component, and/or can include at least a portion that vibrates to facilitate movement of the playing cards. In still further detailed embodiments, the one or more physical playing cards can be dealt by a robotic dealer or other robotic manipulator mechanism.

In various further embodiments of the present disclosure, an automated playing card dealing and retrieval system can be adapted for use at a physical gaming table adapted to host live wager-based table games involving wagers, live game play based on the wagers, and monetary awards based on the results of the live game play. This automated playing card dealing and retrieval system can include a robotic manipulator mechanism, a movable receiving component, an automated card removal component, and/or an automated card return component, among other components. The robotic manipulator mechanism or "dealer" can be adapted to deal a plurality of physical gaming cards at the physical gaming table. The movable receiving component can be adapted to receive one or more of the plurality of physical playing cards while or after the one or more physical playing cards are dealt by said robotic manipulator mechanism for the play of a live wager-based table game at the physical gaming table. The movable receiving component can further be adapted to display at least one of the one or more physical playing cards to one or more players seated away from the physical gaming table during the play of the live wager-based table game. The automated card removal component can be adapted to facilitate the removal of the one or more physical playing cards from the movable receiving component to a discard region after the play of the live wager-based table game involving the one or more physical playing cards. The automated card return component can be adapted to facilitate the return of the one or more physical playing cards from the discard region to another location where the one or more physical playing cards can be processed for the play of a future live wager-based table game at the physical gaming table.

In various detailed embodiments, the automated playing card dealing and retrieval system can further include a card shoe from which the plurality of physical playing cards are dealt, and also an automatic card shuffler adapted to process the one or more physical playing cards after they are returned from the automated card return component and before they are provided to the card shoe. As in the foregoing embodiments, the movable receiving component can include a mechanized tray that is adapted to receive the one or more playing cards at a first position, adapted to be moved to a second position where the one or more playing cards are removed to the discard region, and adapted to display the at least one of the one or more physical playing cards at a third position that is separate from the first and second positions. Again, the display of the at least one of the one or more physical playing cards that is facilitated by the third position of the mechanized tray can result in the at least one of the one or more physical playing cards being elevated from and held at a substantially non-parallel angle to the surface of the physical gaming table. Alternatively, or in addition, the display of the at least one of the one or more physical playing cards can be facilitated by the use of one or more cameras adapted to send still images or video streams of the at least one of the one or more physical playing cards to one or more remotely located gaming terminals. In various further detailed embodiments, the automated playing card dealing and/or retrieval system can further include the physical gaming table itself.

Other apparatuses, methods, features and advantages of the disclosure will be or will become apparent to one with skill in the art upon examination of the following figures and detailed description. It is intended that all such additional systems, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed inventive apparatuses, systems and methods for automated playing card retrieval systems, which may also include automated dealing and/or other components. These drawings in no way limit any changes in form and detail that may be made to the disclosure by one skilled in the art without departing from the spirit and scope of the disclosure.

DETAILED DESCRIPTION

Figure 1A:
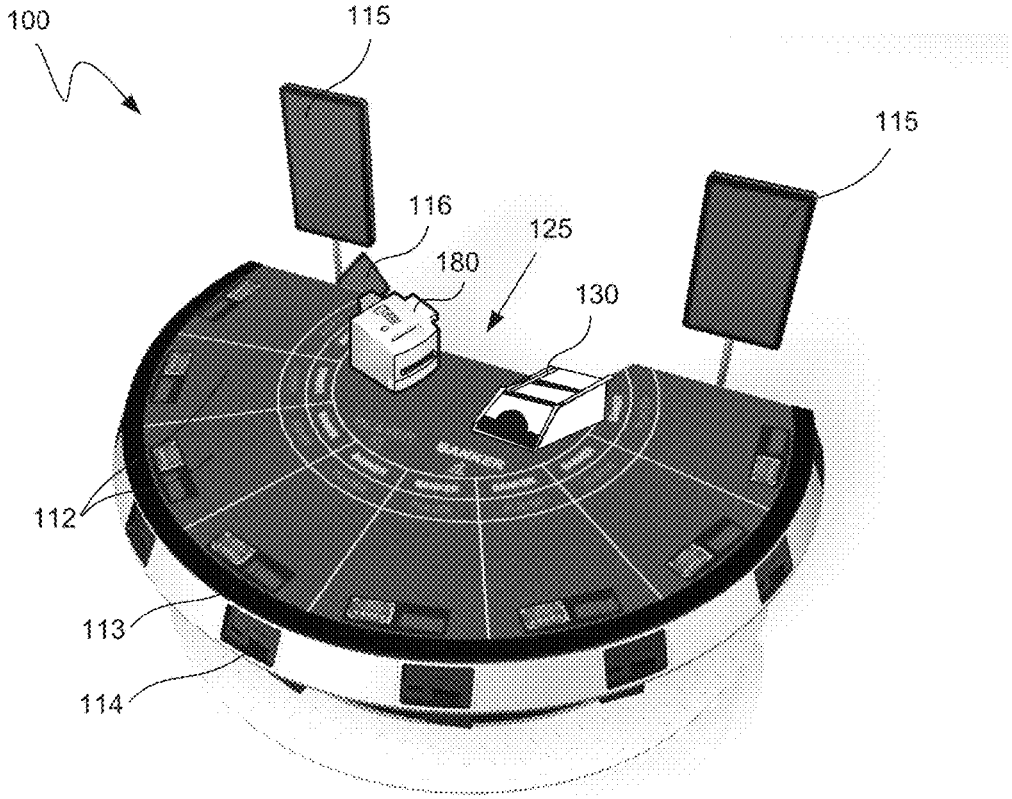
FIGS. 1A and 1B illustrate in top and front perspective views an exemplary physical electronic gaming table adapted for the play of wager-based table games while utilizing an automated playing card retrieval system according to one embodiment of the present disclosure.

Exemplary applications of apparatuses and methods according to the present disclosure are described in this section. These examples are being provided solely to add context and aid in the understanding of the disclosure. It will thus be apparent to one skilled in the art that the present disclosure may be practiced without some or all of these specific details. In other instances, well known process steps have not been described in detail in order to avoid unnecessarily obscuring the present disclosure. Other applications are possible, such that the following examples should not be taken as limiting.

In the following detailed description, references are made to the accompanying drawings, which form a part of the description and in which are shown, by way of illustration, specific embodiments of the present disclosure. Although these embodiments are described in sufficient detail to enable one skilled in the art to practice the disclosure, it is understood that these examples are not limiting, such that other embodiments may be used, and changes may be made without departing from the spirit and scope of the disclosure.

The present disclosure relates in various embodiments to devices, systems and methods for providing, conducting and facilitating the automated administration and play of live wager-based table games at live gaming tables that can include the use of physical gaming items, such as physical playing cards, dice, balls, wheels, reels, spinners, tokens, chips, and the like. Although the present disclosure provides various embodiments with respect to physical playing cards, it will be understood that these embodiments and suitable variations thereof can be extended to other physical components as well, such as, for example, one or more physical dice, balls, wheels, reels, spinners, tokens, chips, and the like, alone or in any combination.

The live wager-based games at the live gaming tables may or may not include live dealers, live players, one or more physical gaming items, and/or an electronic platform with various electronic or computerized components. As such, this disclosure may be applied to any live table game, such as baccarat, blackjack, roulette, craps, pal gow, sic bo, poker, bingo, keno, card games, and the like, as well as any other type of game having a live, robotic, or electronic dealer, and/or one or more players seated at and/or remotely from a physical gaming table. In various embodiments, there may be no human dealer, such that a robotic or electronic dealer administers the games. Further, there may be no players actually seated at the physical gaming table itself, such that all players are playing at gaming terminals that are located apart from or even remotely from the actual physical surface of the gaming table. The various embodiments disclosed herein can be applied with respect to individual gaming tables, entire systems involving multiple tables, and methods of running table games, as well as automated methods of dealing and/or retrieving game items on gaming tables.

The present disclosure contemplates having an automated game play and administration system with respect to physical gaming items located at a physical gaming table or system of gaming tables. Such physical gaming items can be physical playing cards, for example. As such, the physical gaming table can have one or more automated components that are adapted to deal, retrieve, return, shuffle, and/or otherwise process the physical playing cards for a streamlined and efficient automated system. Such an automated playing card dealing and/or retrieval system can include various components, such as, for example, a card shoe, a robotic card dealer or other robotic manipulator mechanism, an automated card receiving component, an automated card removal component, an automated card return component, an automatic card shuffler, and/or the physical gaming table itself, along with various electronic, processing, cameras, displays, and/or communication interfaces or components thereof.

Further distributed system components can include a remote server and/or database or other storage component that are in communication with the various physical electronic gaming tables. In addition, the disclosed electronic gaming tables and systems can be associated with one or more remote player terminals or other similar components. The respective gaming system or network can be of wired (Ethernet, Token Ring, Serial multidrop, etc.) or wireless variety (802.11x, BlueTooth, LTE, 2G/3G/4G cellular, Zigbee, Ultra Wide Band, etc.) known in the art.

In general, the present disclosure can pertain to one physical electronic gaming table, a system of gaming tables, a plurality of physical gaming elements or items, and various components that facilitate an improved automated table game administration process. A relevant electronic gaming table system can include multiple live electronic gaming tables ("eTables") and also a remote server adapted to store, communicate and verify information regarding the various system gaming tables, player terminals, and the like. Other system components can include, for example, remote game terminals (electronic gaming machine ("EGM"), smart phone, smart TV, tablet, desktop computer, etc.), a central games repository and server that tracks live games from each eTable, a multi-site games traffic server, a financial server that acts as a Central Clearinghouse for remote wagers, and/or a network that connects the electronic gaming tables and various other system items.

A table processor and/or remote server can be used to administer the game electronically, track player decisions, decide game outcomes, and/or facilitate the automated dealing, retrieval, and/or recycling of playing cards or other gaming elements at the tables. Other components and items may also be present as desired. Further details and other aspects with respect to the disclosed gaming table systems and remote gaming in general can be found at, for example, U.S. Pat. Nos. 7,914,368; 7,918,723; 7,922,587; 8,182,321; 8,210,920; 8,308,559; 8,323,105; 8,727,892; and 8,920,229, as well as U.S. patent application Ser. Nos. 14/017,073; 14/017,071; 13/948,101; 13/893,340; 13/844,617; 13/542,446; 13/456,110; 13/042,633; and 11/198,218, with the entire contents of all of these patents and applications being incorporated herein by reference in their entireties and for all purposes.

Figure 1B:
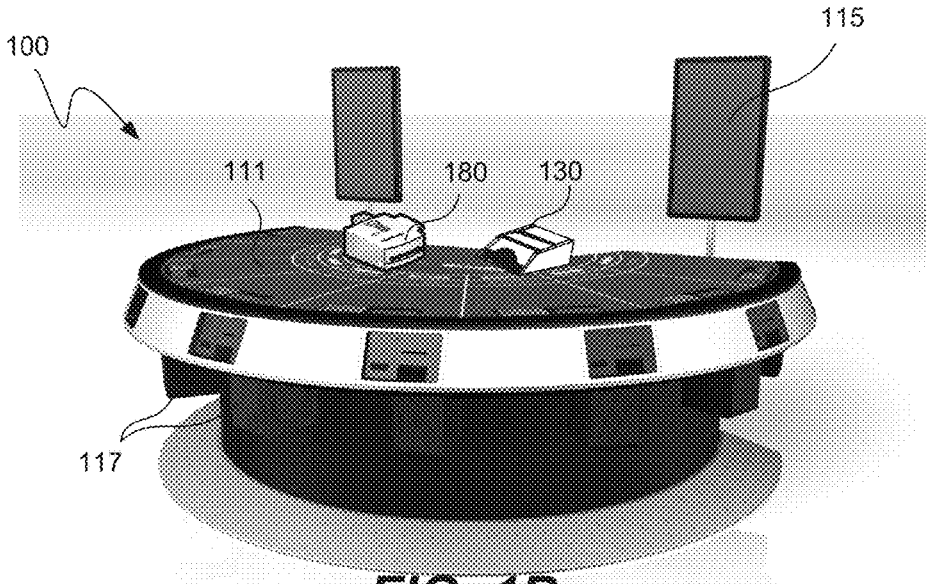

Referring first to FIGS. 1A and 1B, an exemplary physical electronic gaming table adapted for the play of wager-based table games while utilizing an automated playing card retrieval system according to one embodiment of the present disclosure is illustrated in top and front perspective views respectively. It will be readily appreciated that this electronic gaming table ("eTable") 100 can also be provided in numerous other configurations and formats, such that the provided example is for illustrative purposes only. The eTable 100 can include a playing surface 111 adapted for the play of live table games using live physical components, a live dealer station or region 125, a plurality of optional player stations 112, each of which may have its own displays 113, bill acceptor, card acceptor and other input components 114, one or more community displays 115, and a dealer station display and/or computing device 116. One or more physical separators 117 may separate the different player stations 112. In some embodiments, eTable 100 might have no player stations, such that a live human or robotic dealer merely administers a live game at a table with no players, whereby all player action occurs at remote gaming terminals.

Each optional player position 112 around the eTable 100 can have a player terminal integrated into it. Each player terminal can have its own controller, buttons, touchscreen display, bill validator, printer, card reader, and so forth. The player terminals can be connected to a table controller ("TC") for the entire table via a switch/hub, and the TC connects to an overall local or wide area network, as provided in greater detail below. Each eTable 100 can be hosted by a live human dealer or robotic dealer (not shown), such as at a dealer station 125. The live human or robotic dealer can deal real physical playing cards and/or use real physical dice or other physical game components, which can be done on a wooden green-felt table surface 111, for example. Other materials and/or colors may also be used. The TC, such as via player login data (such as player tracking card swipe or a cash insertion at the bill acceptor), knows which positions at the table and/or remotely are active and thus can monitor the progress of a game in some embodiments.

The eTable 100 can also have one or more displays. In one embodiment, there can be one or more community displays 115 to show common player information, such as community cards, table wager minimum, casino name, time, advertisement, and the like. Game history (e.g., baccarat roadmaps) may also be displayed on the same screen 115 or on a separate screen attached to or near the eTable 100. The eTable may also have discrete displays such as On/Off/Flashing lights mounted underneath table graphics to annunciate game information such as Banker Win, Player Win, New Game, No More Bets, and so forth. Such table screens and discrete displays can be driven by the TC.

Physical playing cards can be drawn from an automated card handling device, such as an electronic shoe ("eShoe") 130, which can be connected to the TC on the local table network. In some embodiments, the eShoe 130 or other card handling device can scan or otherwise sense, read, or detect the cards, such as to note the rank and suits for each card removed. One or more table sensors, such as a camera 118, RFID reader, or the like, can be used to capture video of the dealer action for broadcasting, as well as tracking of players and physical game components through a variety of means. The camera 118 can also be used to further verify and keep a log of game activities, such as, for example, cards removed from the eShoe, cards dealt to player positions, bets entered, new players, and the like. In various embodiments, a plurality of cameras 118 can be used, such as, for example, to provide live still images and/or video streaming of dealt playing cards and/or other items in play during the play of a wager-based game at the table 100. Further details regarding the use of cameras to provide still or streaming images of game play to remote gaming terminals can be found at, for example, U.S. Pat. No. 8,727,892, which again is incorporated by reference herein in its entirety and for all purposes.

In various embodiments, a receiving component 140 can be adapted to receive one or more physical playing cards while or after the cards are dealt for the play of a live wager-based table game at the physical gaming table 100. This receiving component 140 can be further adapted to display at least one of the playing cards to one or more players, which can include players seated away from the physical gaming table during the play of the live wager-based table game. This can be accomplished, for example, by way that the card or cards are held by the receiving component 140, and/or may also be accomplished through the use of one or more cameras 118 at the table 100. In some embodiments, receiving component 140 can be movable from one position to another at the table 100. Further features and alternative embodiments for such a movable receiving component are provided in greater detail below.

In addition, an automatic card shuffler 180 or other automated playing card processing component can be adapted to shuffle cards and prepare them for game play at the table, such as by insertion into card shoe 130. Card shuffler 180 can alternatively be located beneath, beside or within table 100, and can also be adapted to scan, sense or otherwise detect cards that are placed therein. Card shuffler 180 can also be connected to the TC on the local table network, such that the TC or some other system component can be made aware of card readings or detections at both the eShoe 130 and the card shuffler 180. As such, action might be taken as appropriate to compare and analyze results at both devices, with alerts being provided in the event that anything problematic is detected. Other devices present at eTable 100 but not shown can include, for example, a card removal component, a card retrieval component, player tracking devices, smart chips, and/or chip racks, as will be readily appreciated.

Figure 2:
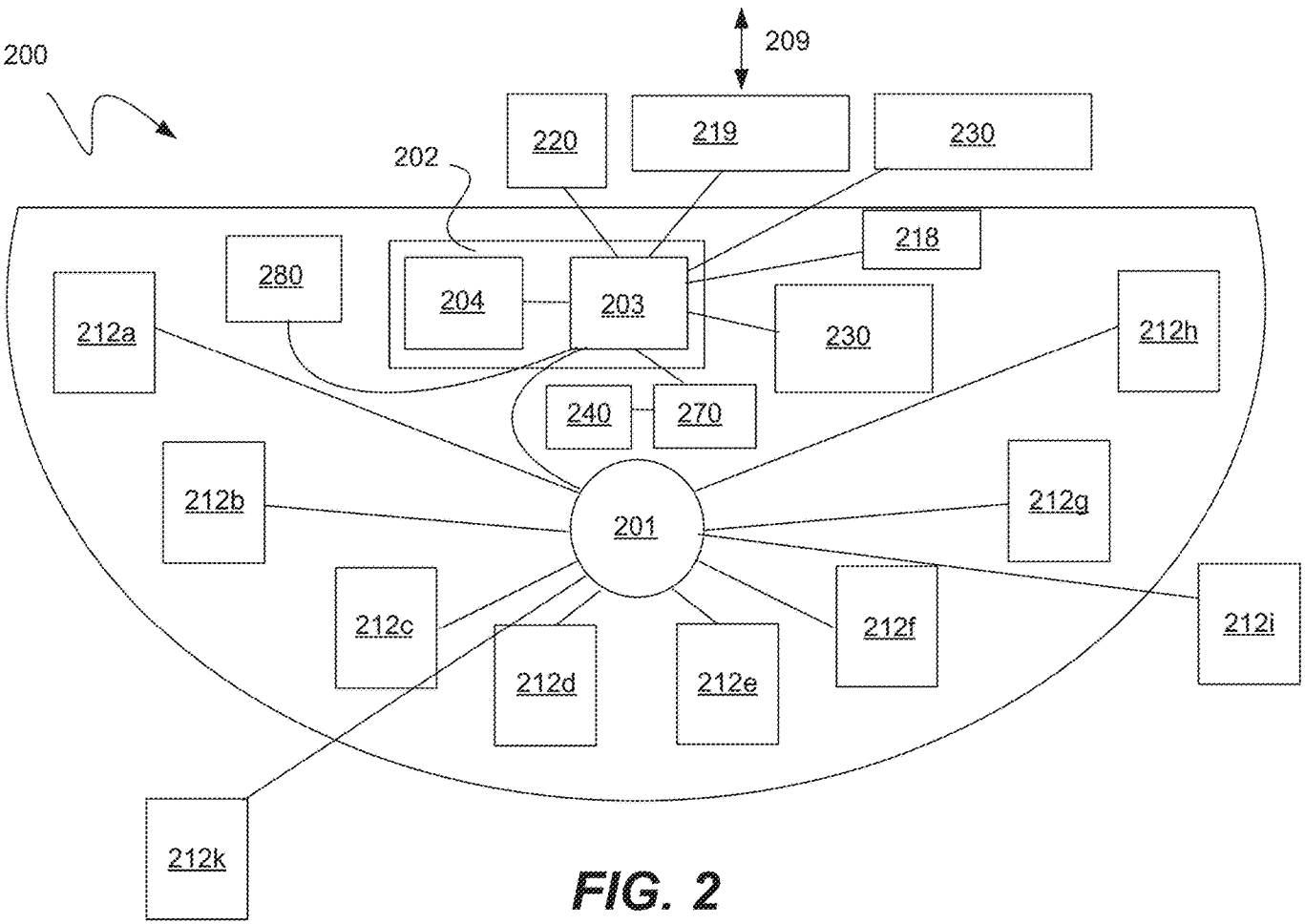
FIG. 2 illustrates in block diagram format an exemplary computing system for a physical electronic gaming table adapted for the play of table games while utilizing an automated playing card retrieval system according to one embodiment of the present disclosure.

Continuing with FIG. 2, an exemplary computing system for a physical electronic gaming table adapted for the play of table games while utilizing an automated playing card retrieval system is provided in block diagram format. Computing system 200 for an eTable can include various individual processors and peripherals 212*a*-212*k* for a plurality of player terminals or stations. In various embodiments, each of these separate items can be an identical or substantially similar set of processors, displays, inputs and other components, as may be desirable for each separate player station. As shown, some of the player stations (e.g., 212*a* through 212*h*) may be physically present at the eTable, while other player stations or terminals (e.g., 212*i* and 212*k*) may be located away from the eTable, as may be desired. Such remotely located player stations or terminals can be nearby the table and within view of the playing surface and or an overhead display of the playing surface, or may be located in a different room or different location entirely, such as where a video feed of the live table game can be provided to the player station for live play, such as through the use of one or more cameras 218. Such remotely located player terminals can be implemented on a third party user device, such as a smart phone, tablet, laptop, PDA, smart glasses, or the like.

All of the player station systems 220*a*-220*k* can couple to a central router or hub 201, which can be coupled to a master table controller ("TC") 202 having a CPU 203 and memory or storage 204. The TC can be coupled to one or more table displays 215, as well as an interface 219 for outside communications. Such table display(s) 215 can provide views of the playing surface to many more players that may be nearby the table but not in position to have a good view of the playing surface. In this manner, dozens or hundreds of players can be playing at a single table. TC 202 can also be coupled to various components in an associated automated card dealing and/or retrieval system. Such components can include, for example, a robotic dealer 220, a smart card shoe 230, a smart card shuffler 280, and an automated card removal component 270, which can be adapted to facilitate the removal of cards from receiving component 230. Further description and details of these components are provided in greater detail below. Link 209 represents the connection to an outside network, so that system 200 is able to communicate with various other outside network or system components.

In various embodiments, a remote game server can administer some or all of the game away from the actual physical table. The remote server can have the rules of the game, and can be responsible to conduct the table game, such that the TC 202 only conducts data acquisition. As such, the TC 202 can be connected to the card shoe 230, automated card removal component 270, card shuffler 280, camera(s) 218, dealer terminal, chip counter, overhead display(s), and so forth. In operation, the TC 202 can collect raw data from these peripherals and then provide this data to the host game server located remotely. The remote host or game server can then provide any number of functions, such as, for example, to monitor automated dealing and physical item retrieval, validate and track playing cards, process the game according to game rules, store the game states, keep track of game history, resolve player hands, credit or debit player accounts, run the community display, and the like. Data from each player terminal can be collected by the table controller or processor (i.e., TC) and forwarded to the remote server, can be sent to the remote server directly from player terminals, or some combination thereof.

In embodiments involving a remote game server, such a game server of the system may be adapted to handle multiple tables simultaneously. In such embodiments, the system can also broadcast games or action at multiple tables to each remote player terminal, thus allowing the player to watch other games and/or participate in more than one game at the same time. In other embodiments, the TC 202 itself can perform all of these functions during game play. In such embodiments, the eTable 200 can be an isolated standalone device, such as a single gaming machine or component.

In various embodiments, there may or may not be live players at the eTable. That is, in some embodiments the eTable may not have any live players sitting at the table, and rather has only the dealer, playing surface, cards and/or other live physical game components. In such embodiments, all live players may wager on and participate in the game action through remotely located game terminals. Again, such remotely located terminals may be nearby the eTable and within view of the playing surface and/or one or more community displays. For example, such nearby player terminals can be within 100 feet of the eTable. Of course, further distances and/or removed locations to other rooms or properties are also possible, such as where the remotely located players can view a video of the live game action.

Figure 3A:
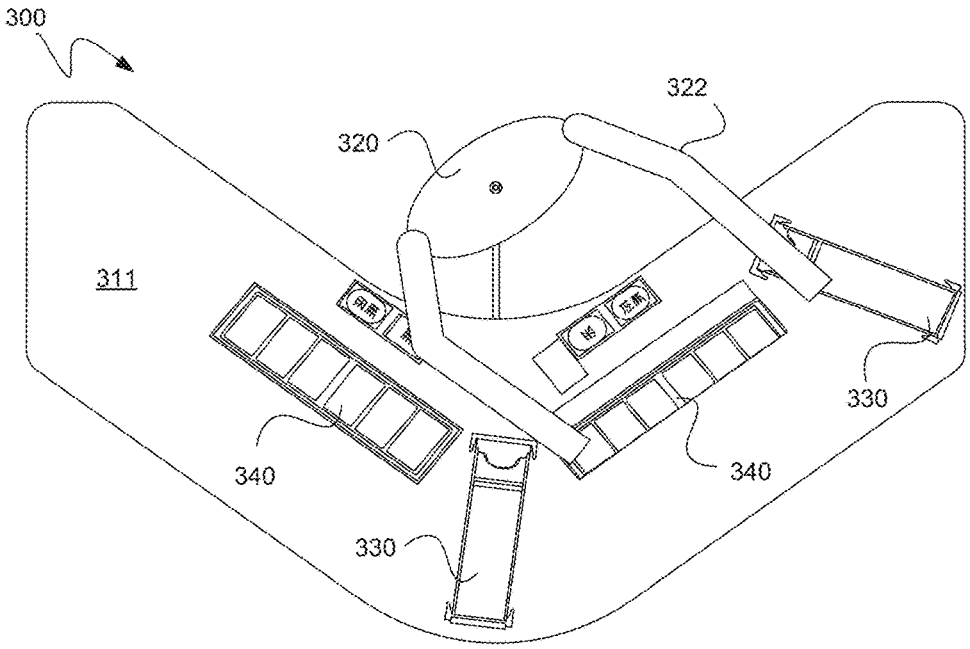
FIG. 3A illustrates in top plan view an alternative exemplary gaming table having an automated playing card retrieval system according to one embodiment of the present disclosure.

Moving next to FIG. 3A, an alternative exemplary gaming table having an automated playing card retrieval system is illustrated in top plan view. Physical gaming table 300 can include a green felt or other playing surface 311, which can have various designated regions and insignia for the play of one or more wager-based table games. While gaming table 300 as illustrated is particularly designed for the play of baccarat, such a gaming table could also be used for blackjack, pai-gow, poker, or any other card game or table game. A robotic dealer or robotic manipulator mechanism 320 having one or more robotic arms 322 is stationed at a dealer position at table 300, and can be adapted to deal physical playing cards from one or more electronic or "smart" card shoes 330.

It will be understood that any suitable automated robotic dealer or robotic manipulator mechanism ("dealer") 320 can be used for the purpose of automated card dealing. As one example, Yaskawa America, Inc.—Motoman Robotics Division of Miamisburg, Ohio makes a robotic card dealer. Other manufactures also make suitable robotic arms or manipulators that can be adapted for this purpose, such as, for example, Barrett Technology of Newton, Mass., and HDT of Solon, Ohio. Other examples of commercially available robotic arms or manipulator mechanisms can be found at www.robotshop.com, among other locations.

In various further embodiments, a customized or improved proprietary robotic dealer 320 can be used. Such a customized robotic dealer 320 can have one or more sensors in one or both robotic arms 322, and can be adapted to use one or both of its robotic arms to deal and manage games at gaming table 300. More than two automated robotic dealer arms might also be used where desired. In such embodiments, each of the multiple robotic dealer arms 322 can be adapted to perform separate functions from each other at the same time. The sensors on robotic dealer 320 can be mounted on robotic arms 322, or elsewhere on the dealer, or on the playing surface of the gaming table 300, or some combination of these. The sensors can be used to sense the presence of playing cards or other physical gaming items at gaming table 300 and can be of various kinds such as optical (CCD arrays, line scanner, photo emitter/sensor, barcode reader, etc.), magnetic (MEMS, magneto resistive, etc.), radio frequency (RFID), and the like. Such sensors can be used to check the rank, suit, and/or other identifying indicia on each playing card, which can confirm that which has been already detected by the smart shoe 330 upon the card being dealt, for example. Further sensors located on or about the gaming table 300 and/or robotic dealer 320 might also be used to sense location of the cards on the gaming table surface or other game pieces such as dice, chips, tokens, buttons, and the like during game play. Additionally, other sensors, such as optical, magnetic, RF, accelerometer, force, rotary encoder, and the like, may be mounted on the robotic dealer 320 or robotic dealer arms 322 to sense position, speed, acceleration, and/or other properties of each robotic arm for control and collision avoidance purposes.

In one specific example, an automated deal of playing cards during a game at gaming table 300 can involve robotic dealer 320 using its left dealer arm 322 to draw a first card from smart shoe 330. As the first card is leaving the smart shoe 330, one or more sensors in the shoe read the card and report the rank and suit of the card to a table controller or other system controller. Robotic dealer 320 can then transfer the first card from its left arm to its right arm, turning the card face up and also sensing the card with one or more dealer sensors and/or table sensors in the process. This additional sensing process can also be reported to the table controller or other system controller, such as to verify the result that was detected by the smart shoe. The right arm of the robotic dealer can then place the first card into an appropriate location for the play of a game at the gaming table 300, and the process is then repeated for further cards during the play of the game. The secondary redundant sensing systems described above can provide another layer of reliability and security for the game. Further, in an implementation where an electronic shoe (smart shoe capable of scanning the cards) is not being used, the secondary redundant sensing systems can become the primary sensing system. For example, an optical sensor such as a camera mounted on the table can read the cards instead of using the smart shoe for reading the cards.

Robotic dealer 320 can not only be more efficient and make fewer mistakes than a human dealer, but can also deal cards and administer or manage table games faster. For example, while a human dealer might average about 5-6 seconds per dealt card for a typical card based table game, robotic dealer 320 can be adapted to deal cards at an average of about 3-4 seconds per dealt card. While robotic dealer 320 can be fully automated, this robotic dealer or manipulator arm(s) can also have a manual override option, such as where human intervention might be desired. Such a manual override can allow for an actual human to step in and fully or partially deal and manage a game at gaming table 300. A partial intervention might allow, for example, a human dealer to retrieve cards, shuffle cards, remove or insert cards into the smart shoe 330, exchange one or more cards, and/or other functions to assist the robot dealer 320.

In some embodiments, robotic dealer 320 can resemble a human dealer, such as by having a head, face, torso, arms, and the like. Such a robotic dealer can have facial expressions or gestures, which may be dependent upon the stage of the game, various game events, and/or game outcomes. For example, robotic dealer 320 might be adapted to turn its head to the left, to the right, up, down, nod, shake, smile, frown, and/or other movements or gestures that appear to be lifelike. In some instances, robotic dealer 320 might also be adapted to speak or provide commentary regarding the game in progress and/or one or more other items of interest.

In various embodiments, the robotic dealer 320 can be adapted to deal to or otherwise manage two or more table games simultaneously. As shown, there are actually two separate card shoes 330 and receiving components 340 at gaming table 300, since robotic dealer 320 can deal to and manage two separate baccarat games at the same time. This can be accomplished using an overall system including various cameras, sensors, and one or more processors associated with robotic dealer 320, such that two games can be tracked and managed electronically at the same table 300 at the same time. In various further embodiments, the table games can be games other than baccarat, such as, for example, blackjack, pai-gow, sic bo, craps, roulette, and the like. The two games at the same table can be the same game, or can be different games. For example, the robotic dealer can be further adapted to deal and manage a baccarat game and a blackjack game at the same table at the same time. As another example, the two games at the same table managed by the same robotic dealer could be a baccarat game and a sic bo game.

The robotic dealer 320 can be adapted to deal playing cards to one or more specific locations at the gaming table 300. For example, cards can be dealt to a card receiving component 340, which component can have various designations with respect to the wager-based game being hosted at the table. As shown, receiving component 340 can have six specific card slots, such as for two baccarat hands that may comprise 2 or 3 cards each (i.e., a "player hand" and a "banker or dealer hand"). In various embodiments, the card receiving component 340 can be movable, such as from a first position to a second position. This movable receiving component 340 can be a section of the gaming table, or alternatively, can be a tray or other separately movable device. Such a tray or other device can be formed from any suitable material, such as plastic, metal, or wood having sufficient thickness and size.

The movable card receiving component 340 can include one or more sensors thereon or thereabout, such as to detect the presence of physical playing cards, to detect whether the card(s) are placed in the correct position and orientation, and/or to verify the actual identity and/or rank and suit of the playing cards. Presence detection sensors can be of a variety of different types, including, but not limited to, optical emitter/sensors, capacitive sensors, RFID sensors, resistive sensors, microswitches, image or camera sensors, barcode readers, and the like. At least one such sensor can be used for each specific card slot or location. Presence detection sensors can detect whether there are one or more physical playing cards on the movable receiving component 340 during game play, as well as to verify that the one or more playing cards have been properly removed from the receiving component at the end of each game.

Location detection may be performed separately from presence detection. To verify that the playing cards are in the correct locations and/or orientations, an image sensor such as a camera can be used. For instance, a camera place on or about the gaming table, on the ceiling above the table, or at one or more locations on the actual card receiving component 340 can be adapted to capture images and/or video of the playing cards, which can be used then to determine the number of cards present, determine the ranks and suits of the cards, determine the relative locations and orientations of the cards, and then report this information back to the game controller and/or other appropriate system controller. In conjunction with the prescribed game rules and with other game play data, such as data reported by the electronic card shoe, the active game state, the number of players involved in the game, the various player choices or input, and so forth, the game controller can then determine whether the correct number of cards were dealt and whether this was done correctly (e.g., to the proper locations). Alternatively, or in addition, an image sensor can also read a preprinted barcode or other identifying indicia on each card to verify its value and suit, rather than having the system perform a more intensive image recognition process for each card.

Figure 3B:
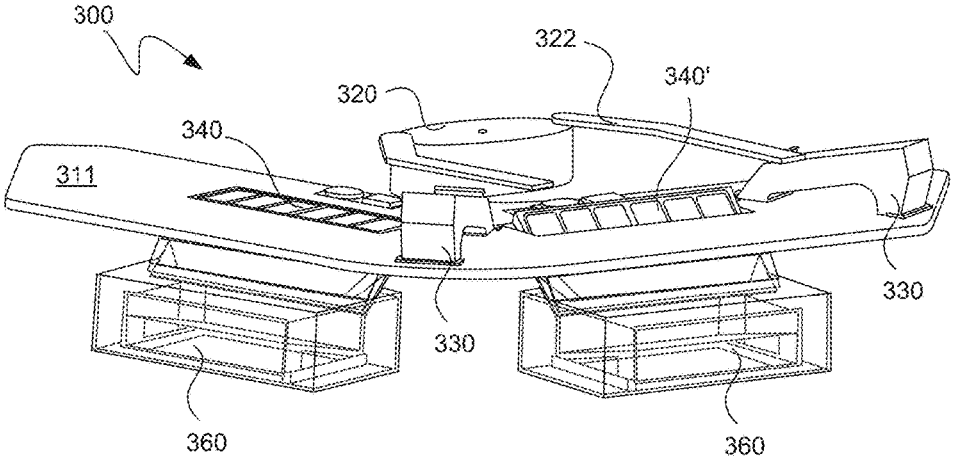
FIG. 3B illustrates in front perspective view the alternative exemplary gaming table having an automated playing card retrieval system of FIG. 3A according to one embodiment of the present disclosure.

Continuing with FIG. 3B, the alternative exemplary gaming table of FIG. 3A is shown in front perspective view. Again, physical gaming table 300 can have a playing surface 311, a robotic dealer 320 having one or more robotic arms 322, one or more smart card shoes 330 from which physical playing cards are dealt, and one or more movable receiving components 340 adapted to receiving playing cards while or after they are dealt by the robotic dealer. As shown in this perspective, the card receiving component 340 on the left is in its ordinary position for the play of a baccarat game. The movable card receiving component 340' on the right is moved into its second position, however, which is downward into the table surface like a trap door. By being moved into this position, the playing cards contained on top of the movable receiving component 340' are removed by either free falling or being guided along a designed path into a container 360 or other region where the cards can then be further processed. Such a second position for movable card receiving component 340' can take place at the end of a given game of baccarat, for example, or at any other appropriate time where cards are to be discarded.

An automated card removal component under or adjacent to receiving component 340, 340' can be adapted to move the receiving component between its first card "receiving or displaying" position and its second card "discard or removal" position. Such a card removal component can be a simple servo motor that is directly or indirectly coupled to one or more gears, belts, and/or pulleys in order to move the receiving component between its two positions. The motor for the automated card removal component can also be controlled in automated fashion, such as when the overall system determines that a game is finished and is ready to start a new hand, for example. Further positions for the movable receiving component 340 are also possible if desired. For example, a third position may represent a better display position of the playing cards to players and bystanders. As such, the cards can be dealt to the receiving component at a "receiving" position 340 that is substantially parallel to the table surface 311, the receiving component can then be automatically moved to another "display" position (not shown) for better view of the cards, and then the receiving component can be moved to a "discard" position 340' where cards are removed or discarded to prepare for a new game.

Discarded playing cards can collect in container 360, from where they can be returned to other automated system components, such as a card shuffler (not shown) and/or a card shoe 330. Such a card return can be performed manually by personnel, or can also be through the use of one or more automated card transport and/or return components (not shown). Such one or more automated card transport and/or return components can include, for example, a conveyor, an air blower, a vacuum component, a vibrating section, and one or more slanted, tilted, or otherwise biased regions to force or guide cards along a desired return path.

Figure 4A:
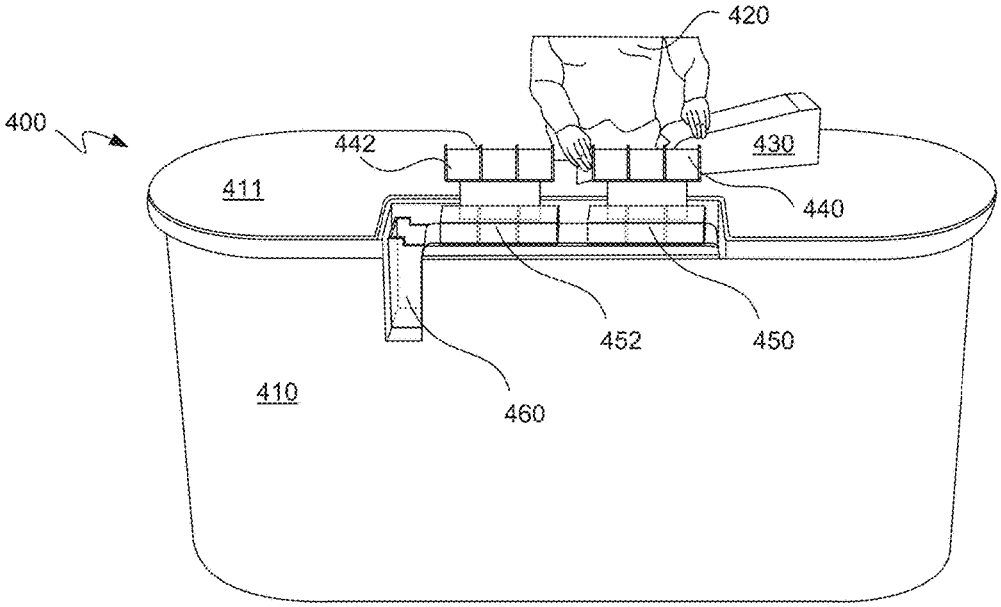
FIG. 4A illustrates in front perspective view another alternative exemplary gaming table having an automated playing card retrieval system prior to playing cards being dealt according to one embodiment of the present disclosure.

Turning next to FIG. 4A, another alternative exemplary gaming table having an automated playing card retrieval system is illustrated in front perspective view. As shown, system phase 400 depicts the gaming table and system components prior to playing cards being dealt for a table game. Similar to the foregoing embodiment, gaming table 410 can have a felt or other suitable playing surface 411, as well as a dealer 420 and a card shoe 430. Again, the dealer can be a robotic dealer, and the card shoe can be an electronic or smart shoe. Two movable card receiving components 440, 442 are located out in front of the dealer, and are ready to have playing cards dealt to them. Two discard regions 450, 452 are on the table surface in front of each of the movable receiving components 440, 442 respectively. A discard sleeve or rack 460 provides another region away from the discard region where cards can be subsequently moved or placed.

Figure 4B:
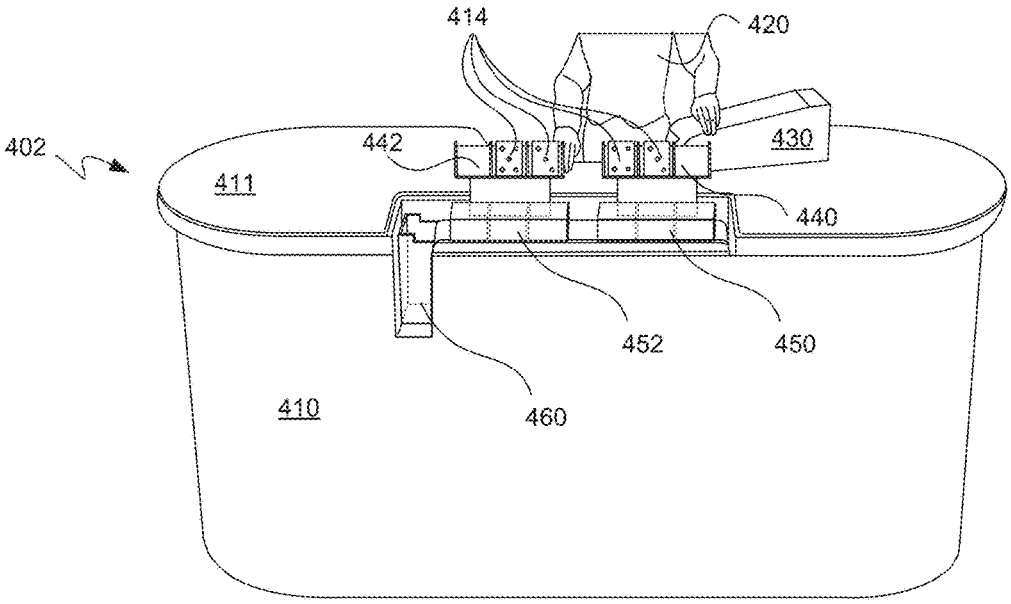
FIG. 4B illustrates in front perspective view the alternative exemplary gaming table having an automated playing card retrieval system of FIG. 4A after playing cards have been dealt according to one embodiment of the present disclosure.

FIG. 4B also illustrates in front perspective view the gaming table of FIG. 4A, but after game play has begun. System phase 402 depicts the gaming table 410 and system after playing cards 414 have been dealt for the play of a baccarat game. Robotic dealer 420 can deal playing cards from the smart shoe 430 to both receiving components 440, 442. Receiving component 440 can hold the player hand, while receiving component 442 can hold the banker hand for the game. In various embodiments, the dealer 420 can deal the cards 414 directly to the receiving components 440, 442 face-up, such that they are immediately displayed. Alternatively, one or more cards can be dealt face-down (such as for blackjack), or cards can be dealt to the receiving components 440, 442 at one position, whereupon they are then rotated or otherwise moved to another position that is better for displaying the cards.

As shown, the receiving components 440, 442 hold and display the playing cards 414 thereon at a location that is elevated from the gaming table surface 411. In addition, the cards 414 are displayed at an angle that is substantially non-parallel with respect to the horizontal gaming table surface 411. Such an angle can approach 90 degrees, although it is thought that 60 or 45 degrees are suitable angles with respect to the table surface as well. As will be appreciated, by holding and displaying the cards at an elevation and at such an angle, it is possible for players and bystanders that are some distance away from table 410 to see the cards that are in play by a direct line of sight. This more prominent display is a significant improvement over the relatively low visibility of the traditional placement of cards in play that are merely laying face-up on the gaming table surface.

In addition to the improved ability to see the cards by a direct line of sight from a distance away from the gaming table, one or more cameras can also be present in order to provide for a live video or picture feed to remotely located players, such as those at remote game terminals or mobile devices. The camera(s), if present, can be positioned at the gaming table in such a way so as to capture and transmit images of the cards 414 as they rest in the receiving components 440, 442 as shown in FIG. 4B.

Continuing now with FIGS. 5A-5D series of images in front perspective view show a progression of a playing card removal and partial return process for the exemplary gaming table and automated playing card retrieval system of FIGS. 4A-4B. Starting with FIG. 5A, system 500 phase depicts the positions of the various table items and components just after the finish of a game of baccarat. In particular, gaming table 510 can have a playing surface 511, a robotic dealer 520, a smart card shoe 530, movable receiving components 540, 542 for each of a player and banker hand, both of which contain physical playing cards 514 thereon, discard regions 550, 552 for each of the receiving components, and a discard sleeve, rack, or chute 560 for the discarded cards to be moved to after they exit the discard regions. In system phase 500, the movable receiving components 540, 542 have both just begun to move as the hand has ended.

Figure 5A:
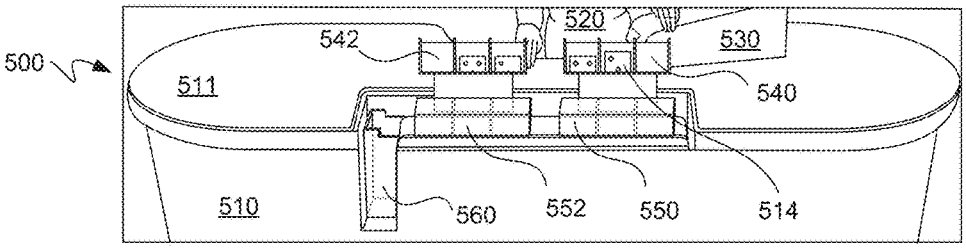
FIGS. 5A-5D illustrate in a series of front perspective views a playing card removal and partial return process for the alternative exemplary gaming table having an automated playing card retrieval system of FIGS. 4A-4B according to one embodiment of the present disclosure.
Figure 5B:
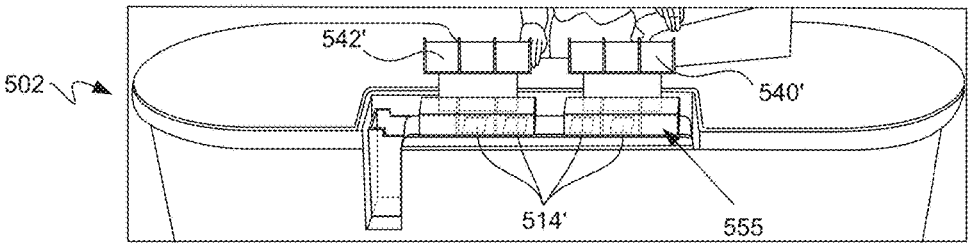

In FIG. 5B, system phase 502 depicts the cards 514' lying face down on the table surface just after they have been removed or discarded from the movable receiving components 540', 542', both of which are now moved to a second position such that the cards fell out therefrom. In various embodiments, each of the movable receiving components 540, 542 can rotate forward and backward about an axis through or about through its base. As such, a first position can be reclined as shown in FIGS. 4A and 4B where cards can be dealt right into the receiving components. Upon rotating forward, the cards are then effectively dumped out onto the surface of the gaming table at the discard regions 550, 552, as shown. The movable receiving components 540, 542 can be moved or manipulated by an automated card removal component (not shown), such as a servo motor and associated gears and belts, for example. Of course, other arrangements with other types of displays, receiving component movements, and discard mechanisms are also possible, as will be readily appreciated.

Figure 5C:
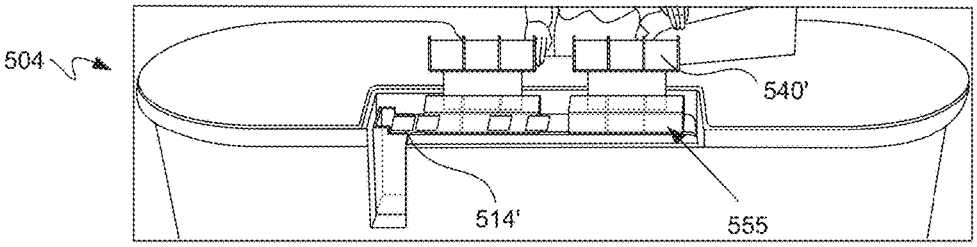
Figure 5D:
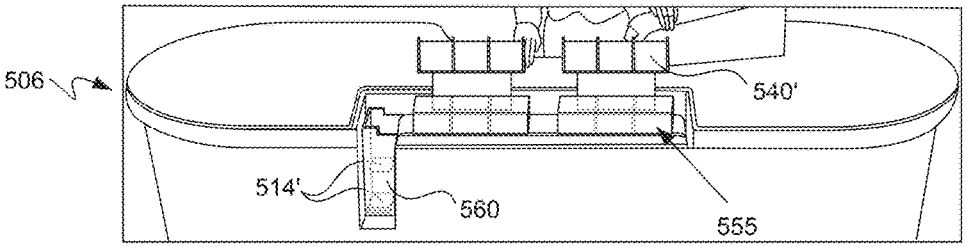

As the cards 514' lay in the discard regions 550, 552, they are then able to be moved or otherwise manipulated by one or more automated card return components 555. Such card return components help to or completely facilitate the return of the cards to an automatic shuffler and then the card shoe 530, such that they can be reused for future wager-based games. As shown in FIGS. 5C and 5D, an activated automated card return component 555 can move the cards 514' along toward the card chute or rack 560. The movable receiving components 540', 542' may remain in these second positions at this time, but will eventually rotate or otherwise move back to their first positions in order to receive new cards for the next game. In FIG. 5D, the cards have all entered the card chute or rack 560, where they can either be manually retrieved and put into a card shuffler, or alternatively, further automated card return components can facilitate directing the cards into the card shuffler.

Automated card return component 555 can be any of a number of items or components that are adapted to facilitate the return of the physical playing cards 514 from the discard regions 550, 552 to another location where they can be processed for the play of a future live wager-based table game at the table. As such, card chute or rack 560, as well as any other automated components between chute 560 and the card shuffler or shoe can also be considered as automated card return components as well. For card return component 555, any number of items can suffice to move the discarded cards across the table and into chute or rack 560. For example, a conveyor belt or other conveyance may transport the cards. Alternatively, or in addition, an air blower and/or a vacuum system may facilitate the card return process. Also, or in addition, card return component 555 can comprise a section of the table that is elevated and adapted to vibrate. That is, when the automated system determines that cards have been discarded from receiving components 540, 542, a vibration ability for return component 555 can be activated, which can help to move and guide the cards along this section of the table. Other devices and ways of moving and returning cards for future games in an automated fashion are also possible, as will be readily appreciated.

Figure 6A:
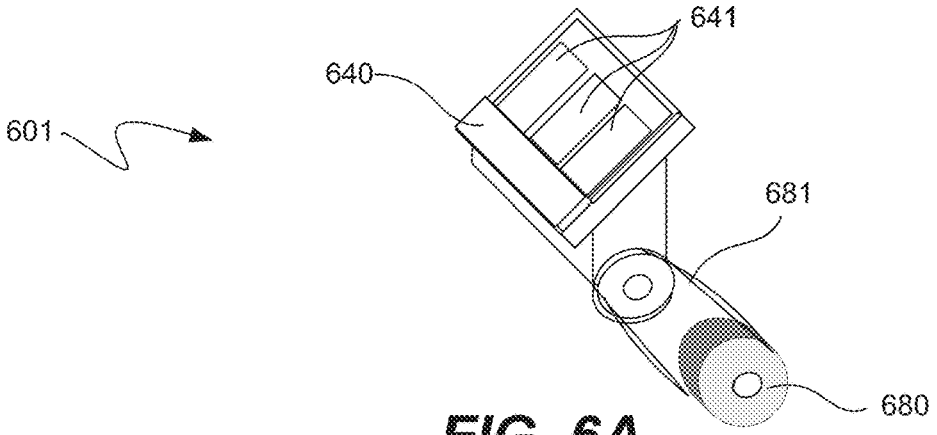
FIGS. 6A-6C illustrate in a series of side perspective views a playing card removal process for a movable receiving component and automated card removal component according to one embodiment of the present disclosure.
Figure 6B:
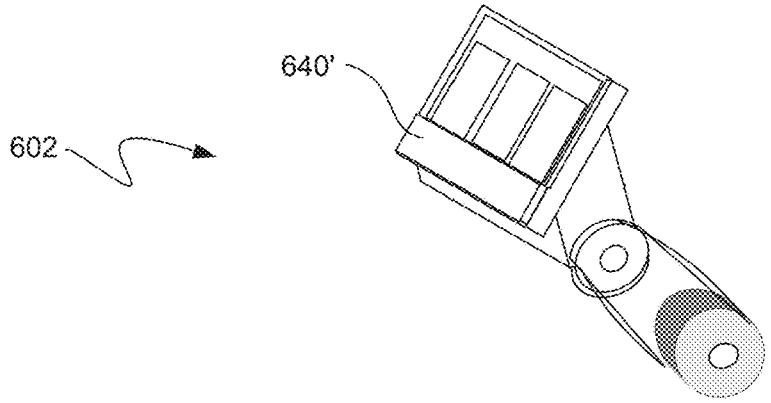
Figure 6C:
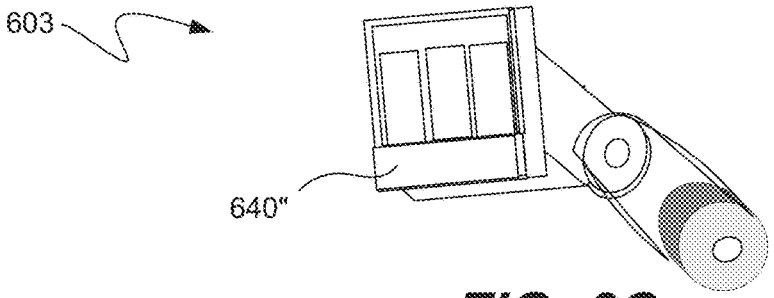

Turning next to FIGS. 6A-6C, a series of side perspective views of a playing card removal process for a movable receiving component and automated card removal component are depicted. In system phase 601, a movable receiving component 640 can be substantially similar to the movable receiving component 540 of the previous embodiment. Such a movable receiving component can be a mechanized tray, for example, which can be constructed from any suitable durable material, such as plastic, metal, wood, or the like. Mechanized tray 640 can have spaces 641 for exactly three playing cards, such as for a baccarat hand. It will be readily appreciated that more or fewer card slots or spaces can be implemented for other games, with appropriate adjustments to the mechanized tray, as may be necessary.

Mechanized tray 640 can be adapted to rotate about its base, such that it can rotate back to hold cards in a steady and visible position, and then rotate forward such that the cards fall out. Tray or receiving component 640 can be driven by an automated card removal component to rotate forward and backward. Such a removal component can be, for example, a servo motor 680 or other suitable electromechanical component, which can engage with the mechanized tray 640 by way of belts 681, or pulleys, gears, or other suitable drive component. Motor or other removal component 680 can be controlled by a local and/or overall system processor(s), such that it drives the movements of the mechanized tray 640 at the appropriate times.

As seen in FIG. 6B, system phase 602 involves the mechanized tray or other movable receiving component 640' having rotated and pitched forward part way to its full forward discard position. Such a fully rotated forward discard position for receiving component 640" can be seen in system phase 603 of FIG. 6C, where the cards contained in the card spaces or slots will then fall out onto the gaming table. The motor or other removal component can then rotate or otherwise move or manipulate the mechanized tray back to its fully upright position in order to start a new hand. Again, such a fully upright or "first" position preferably holds the playing cards at an elevation above the table surface, and at an angle that is substantially non-parallel to the surface of the gaming table, such that players who are far away from the gaming table actually have a chance to see the cards during the play of the game.

Figure 7A:
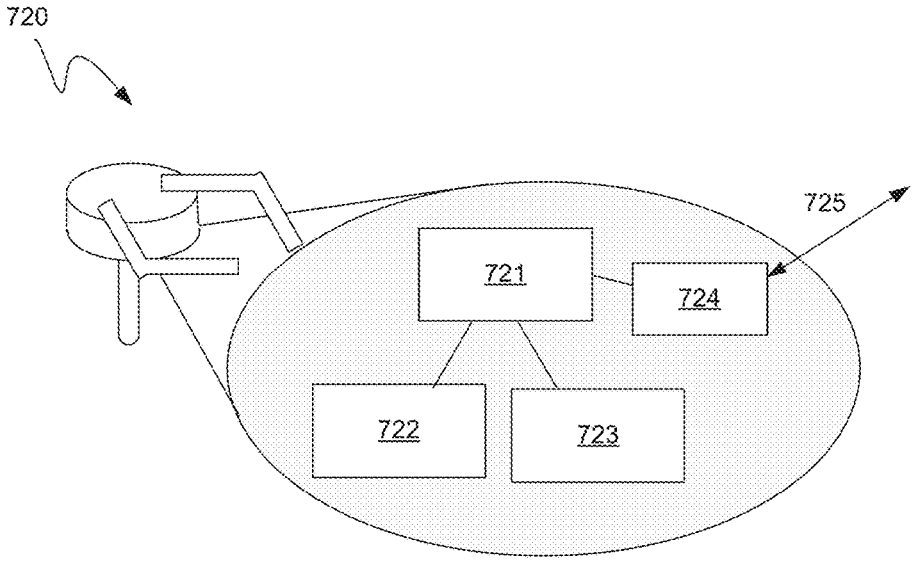
FIG. 7A illustrates in block diagram format an exemplary robotic dealer for use with an automated playing card retrieval system according to one embodiment of the present disclosure.
Figure 7B:
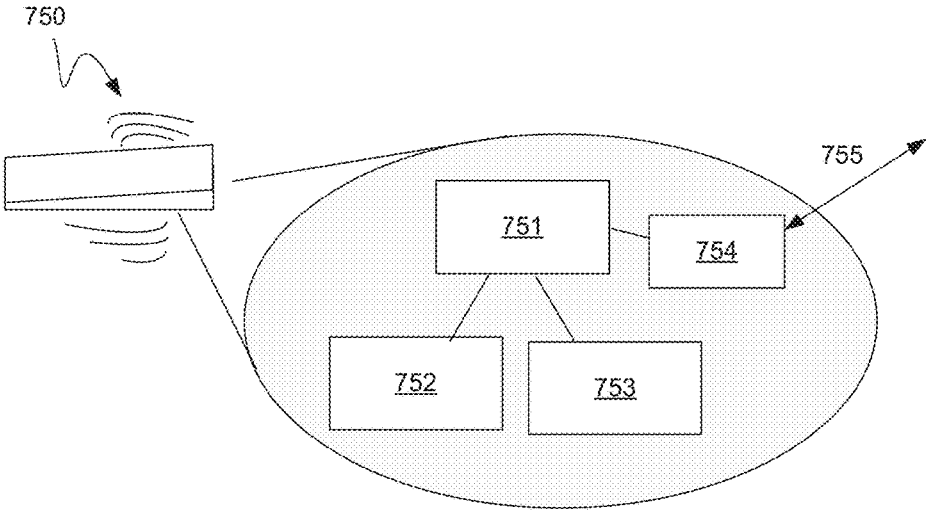
FIG. 7B illustrates in block diagram format an automated card return component for use with an automated playing card retrieval system according to one embodiment of the present disclosure.

FIG. 7A illustrates in block diagram format an exemplary robotic dealer for use with an automated playing card retrieval system, while FIG. 7B similarly illustrates in block diagram format an exemplary automated card return component also for use with an automated playing card retrieval system. Robotic dealer or robotic manipulator mechanism 720 can be specifically adapted to deal playing cards from a card shoe for the automated play of wager-based table games, such as baccarat, blackjack, pai-gow, and the like. Such automated play can include the use of a movable receiving component and an automated card removal component such as those illustrated above, as well as other possible components of an automated dealing and/or playing card retrieval system. Various items can be used with robotic dealer or manipulator mechanism 720 to facilitate the sensing and dealing of playing cards, as well as other items if desired. Robotic dealer 720 can include, for example, a local processor 721 that is coupled to a robotic arm 722, one or more drive motors and their associated electronics 723, and a communication interface 724, among other possible electronic components. Such other components can include sensors, secondary motors, secondary arm segments, grippers, and other components understood to be part of robotic dealers in general. The communication interface 724 can include an external link 725 that couples the robotic dealer or manipulator 720 to a table controller and/or other external system device or processor, as may be desired.

Again, a table controller can control the overall operations of the gaming table. Such a table controller can be a typical embedded controller system, such as in the various controllers and items used in electronic tables and electronic gaming machines. The table controller can have one or more processors, associated memory and permanent storage, system bus, one or more peripheral interfaces (USB, Serial, Parallel, Ethernet, digital I/O's, wireless transceivers, etc.). The table controller preferably has an operating system and one or more application software. The application software may include a game application software as well as peripheral software such as drivers to control and to receive data feedbacks from various game table custom-designed peripherals, such as an electronic card shoe, cameras, presence sensors, the card receiving component 340, the automated card return component 750, a robotic dealer 720, a bill acceptor (not shown), a card shuffler (not shown), as well as other non-custom designed peripherals such as a printer, a magnetic stripe card reader, a barcode scanner, a display, a keyboard, etc. The table controller also has one or more external interfaces such as wired Ethernet or wireless 802.11x to interact with and report to external servers such as the casino accounting server, player tracking server, progressive jackpot server, advertising server, bonus server, audit server, financial servers, and the like. Game application software may comprise game rules and exception handlings, as well as game accounting data such as game cards being used, game states, game history, each player ID, win/loss history, account balance, and the like, in an associated database.

As noted above, an automated card return component 750 can also be electronically controlled. As such, card return component 750 can include a local processor 751, one or more physical card moving items 752, and various motors 753 or other drive components to control the card moving item(s). Again, such physical card moving items can include, for example, a conveyor belt, a vacuum system, an air blower, a vibrating track, and one or more tilted, slanted, or otherwise guided or biased tracks or sections. One or more card sensors (not shown) may also be part of the automated card return component, if desired. Such items can include, for example, optical emitters or sensors, capacitive sensors, RFID sensors, resistive sensors, microswitches, image or camera sensors, barcode or indicia readers, and any other suitable sensors. These sensors can be used to sense the presence or absence of returning playing cards, as well as to verify that the correct number of cards are present. These sensors may also be used to identify each individual card, if desired. Similar to the foregoing card shoe 830, local processor 751, which can control card moving items 752 and drive components 753, can also be in communication with a table controller and/or other external system devices or processors by way of a communication interface 754 and communication link 755.

Figure 8A:
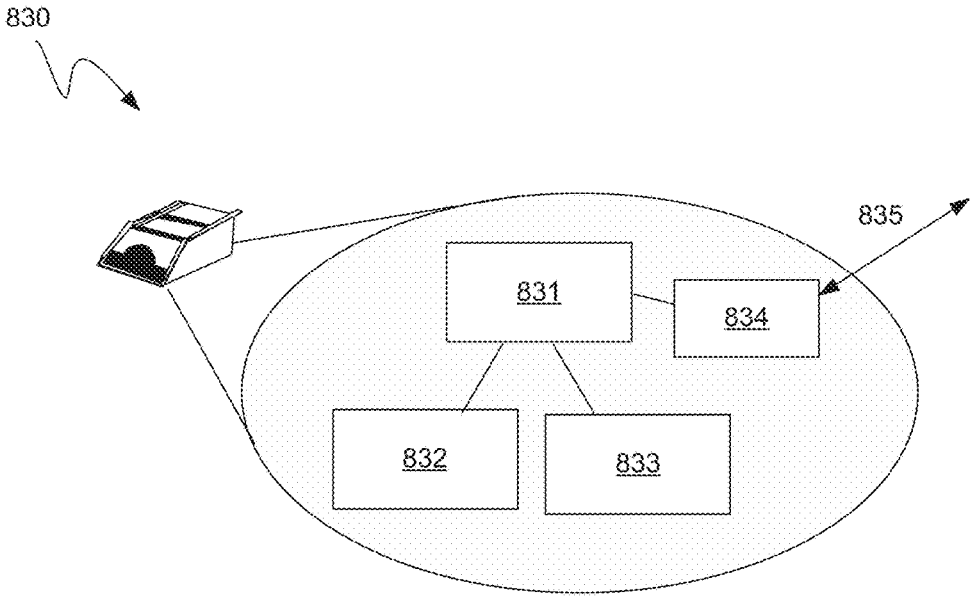
FIG. 8A illustrates in block diagram format an exemplary electronic card shoe for use with an automated playing card retrieval system according to one embodiment of the present disclosure.
Figure 8B:
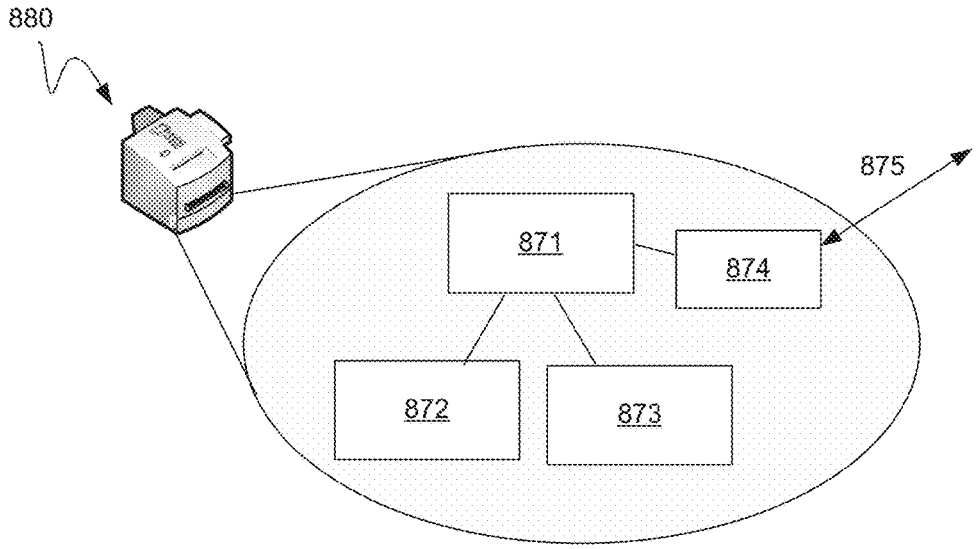
FIG. 8B illustrates in block diagram format an exemplary automatic card shuffler for use with an automated playing card retrieval system according to one embodiment of the present disclosure.

FIG. 8A illustrates in block diagram format an exemplary electronic card shoe for use with an automated playing card retrieval system, while FIG. 8B similarly illustrates in block diagram format an exemplary automatic card shuffler for use with an automated playing card retrieval system. Electronic card shoe 830 can be specifically adapted to hold one or more decks of playing cards for the automated play of wager-based table games, such as baccarat, blackjack, pai-gow, and the like. Such automated play can again include the use of the above robotic dealer or other robotic manipulator mechanism, as well as other components of an automated dealing and/or playing card retrieval system, as will be readily appreciated. Various sensors can be used with electronic card shoe 830 to detect and/or track playing cards, if desired. Again, such sensors can include, for example, optical emitters and sensors, capacitive sensors, RFID sensors, resistive sensors, microswitches, image or camera sensors, barcode readers, and the like. Electronic card handler or shoe 830 can include, for example, a local processor 831 that is coupled to a first sensor 832, an optional second sensor 833, and a communication interface 834, among other possible electronic components. The interface 834 can include an external link 835 that couples the smart card shoe 830 to a table controller and/or other external system device or processor, as may be desired. Further examples and details with respect to an electronic or smart shoe can be found at, for example, U.S. Pat. No. 8,920,229, which again is incorporated by reference herein in its entirety and for all purposes.

Similar to the smart shoe 830, an automatic card shuffler 880 can include a local processor 881 that is coupled to one or more sensors or other components, 882, 883, and a communication interface 884. The interface 884 can similarly include an external link 885 that couples the automatic card shuffler 880 to a table controller and/or other external system device or processor. Similar to the smart shoe 830, the automated or automatic card shuffler 880 can be adapted for use in an overall automated playing card retrieval system, such that playing cards can be dealt, discarded, returned, shuffled, and restocked into the shoe in a fully automated and recycled fashion. As such, one or more additional robotic components can serve to feed cards into and remove shuffled cards from the automatic card shuffler 880.

Figure 9:
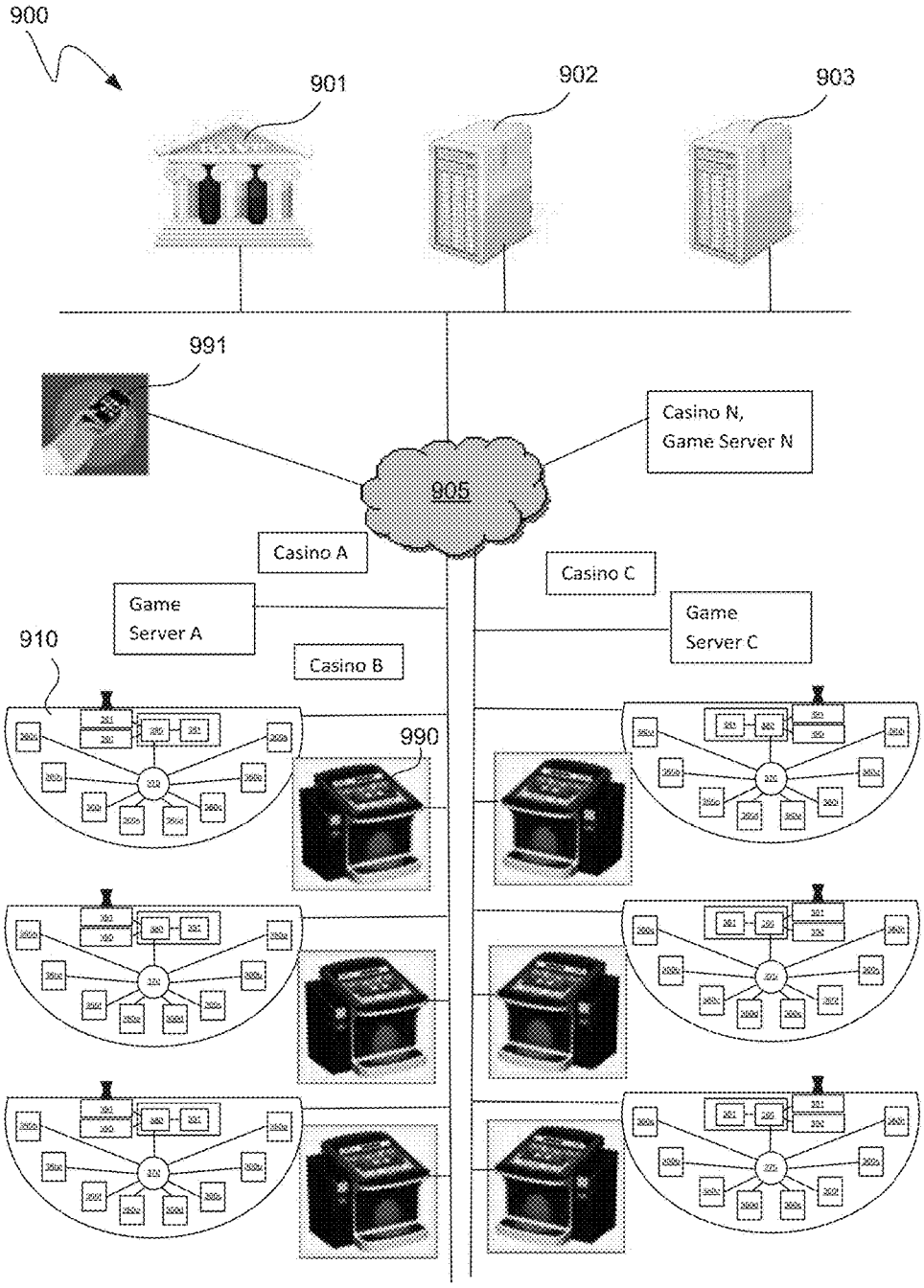
FIG. 9 illustrates in block diagram format an exemplary wide area electronic gaming system utilizing multiple player terminals, multiple electronic tables and various other system components across multiple locations according to one embodiment of the present disclosure.

Transitioning to FIG. 9, an exemplary electronic gaming system utilizing multiple electronic tables, a remote system server, a database, and various other system components across multiple locations is illustrated in block diagram format. Wide area system 900 can include a wide variety of components and items, such as a bank 901, a games router 902, and a financial clearinghouse 903. A cloud 905 or network can couple these items to various eTables, terminals, game servers, casinos, and other distributed components. One or more personal devices 991 can serve as remote player terminals in some embodiments. Various networked casinos, game servers, eTables 910 and other remote terminals 990 can also be coupled through the cloud 905 or network in wide area system 900.

One or more game servers may be present in wide area system 900, and each operates in a particular manner to facilitate the play of the various table games set forth above. In such embodiments, a game server can collect live game information from each eTable, apply game rules, and return game results. Besides monitoring and controlling the games, the game server can also keep track, in a database, ongoing automated dealing and/or physical item retrieval of, as well as the presence and identifying information for various system playing cards or other game elements, as well as the game history of each eTable, accounting information, revenue reports, maintenance information, and the like. Each of these individual functions can be performed by a separate application on a separate server, or integrated into one application running on one comprehensive server. The determination of one or multiple servers and applications depends on the number of eTables, game stations, remote gaming terminals, both local and remote, that are being connected across the system.

Further functions of the system servers can include game resolution at various tables, the handling of financial transactions from remote game terminals, the push of live game information to the game server to be broadcast to remote gaming terminals, matchmaking between player terminals and gaming tables, providing communications between tables and other system components, and other pertinent gaming system functions. Details regarding these and other table gaming system functions can be found at, for example, previously incorporated U.S. patent application Ser. Nos. 14/017,073; 14/017,071; 13/948,101; 13/893,340; and 13/844,617, among other locations.

Figure 10:
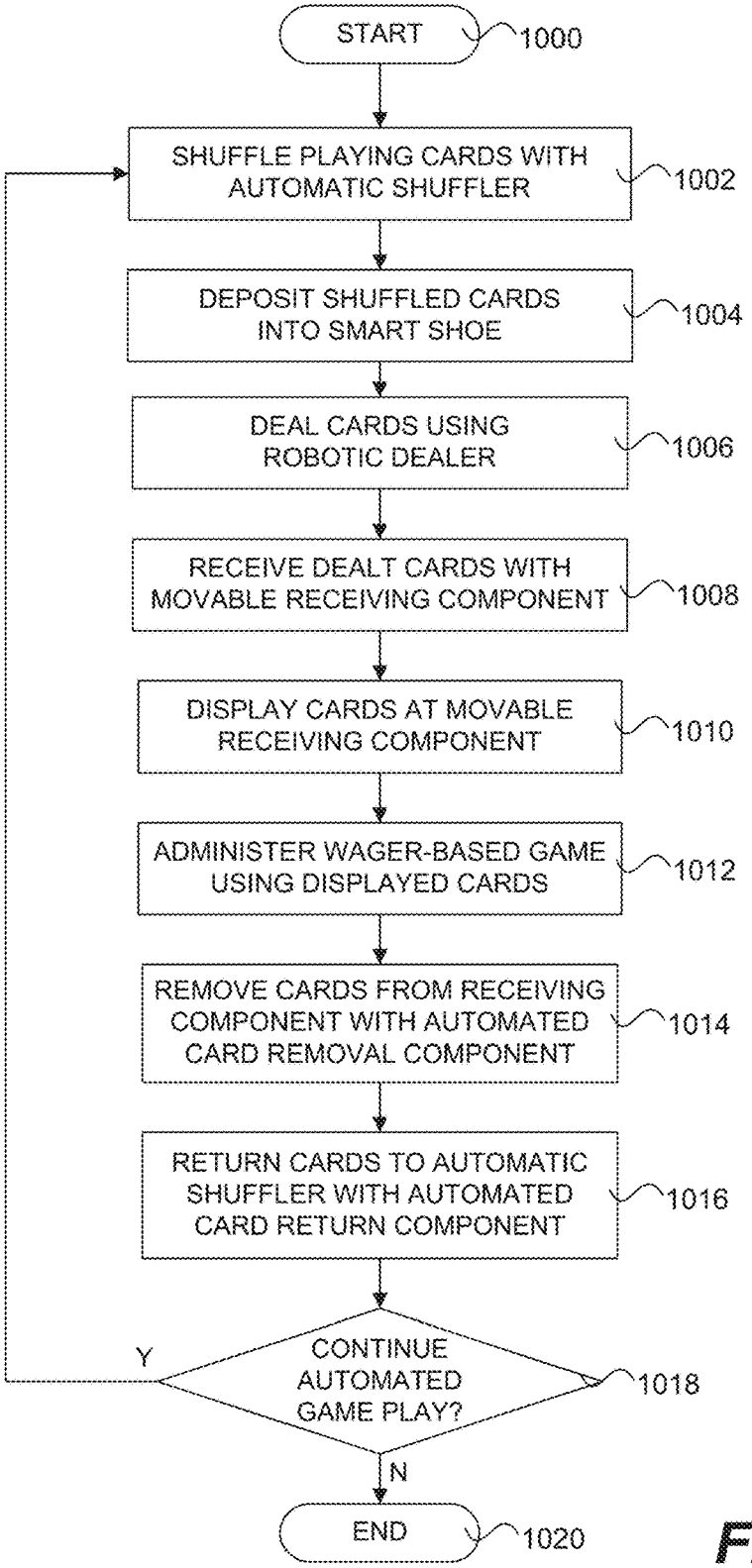
FIG. 10 provides a flowchart of an exemplary method of administering wager-based games at a physical gaming table with an automated playing card retrieval system according to one embodiment of the present disclosure.

Moving lastly to FIG. 10, a flowchart of an exemplary method of administering wager-based games at a physical gaming table with an automated playing card retrieval system is provided. After a start step 1000, a plurality of physical playing cards are shuffled with an automatic card shuffler at a process step 1002. As noted above, the automatic card shuffler can be adapted to shuffle numerous cards, such as one, two, or many 52 or 53 card decks of cards at the same time, as may be desired. Shuffled playing cards are then deposited into a smart card shoe at process step 1004, where the cards are then ready to be dealt into play during the play of one or more wager-based games, such as baccarat, blackjack, pai-gow, and the like.

At a process step 1006, one or more physical playing cards are then dealt from the smart shoe by a robotic dealer, and the dealt card(s) are received with a movable receiving component at process step 1008. The dealt and received card(s) are displayed at the movable receiving component at process step 1010. A wager-based table game using the displayed card(s) can be administered at process step 1012, which may be automated as well. Such game administration can include, for example, logging wagers, determining game outcome according to game rules, and paying one or more game winners a monetary award, if applicable, among other administrative tasks and features.

The method then continues to process step 1014, where the physical playing card or cards are removed from the movable receiving component using an automated card removal component. Various illustrative examples for such a receiver and removal arrangement are provided above. At process step 1016, the card(s) are then returned to the automatic card shuffler with an automated card return component. Process steps 1002-1016 can represent a closed loop cycle, some or all of which may be fully automated such that game play is more streamlined and more accurate than with the use of human dealers or other personnel.

At a subsequent decision step 1018, an inquiry is then made as to whether the automated game play is to continue with the now recycled playing cards. If so, then the method reverts to process step 1002, and all steps are repeated. If not, and game play is thus over, then the method ends at end step 1020.

For the foregoing flowchart, it will be readily appreciated that not every method step provided is always necessary, and that further steps not set forth herein may also be included. For example, added steps to involve further automation and details of table game play and administration may be added. Furthermore, the exact order of steps may be altered as desired, and some steps may be performed simultaneously. For example, step 1006 may be performed before or at the same time as step 1008 in various embodiments. As another example, steps 1008 and 1010 can be performed simultaneously as well. In addition, while the provided examples are with respect to wager-based table games such as playing card games, it will be readily understood that other casino and wagering games can be similarly adapted to provide similar game component tracking, such as for dice, chips, balls, markers, tokens and the like.

It should be understood that the devices, systems and methods described herein may be adapted and configured to function independently or may also interact with other systems or applications, such as for example, a casino management system or player tracking system. As such, automated playing card dealing and/or retrieval data, as well as player tracking data may be recorded and stored in connection with casino or resort management data, player information, or other data retrieved from a table, terminal or other pertinent location. It should also be readily apparent that additional computerized or manual systems may also be employed in accordance with the disclosure in order to achieve its full implementation as a system, apparatus or method.

Those skilled in the art will readily appreciate that any of the systems and methods of the disclosure may include various computer and network related software and hardware, such as programs, operating systems, memory storage devices, data input/output devices, data processors, servers with links to data communication systems, wireless or otherwise, and data transceiving terminals, and may be a standalone device or incorporated in another platform, such as an existing electronic gaming machine, portable computing device or electronic platforms with multiple player positions. In addition, the system of the disclosure may be provided at least in part on a personal computing device, such as home computer, laptop or mobile computing device through an online communication connection or connection with the Internet. Those skilled in the art will further appreciate that the precise types of software and hardware used are not vital to the full implementation of the methods of the disclosure so long as players and operators thereof are provided with useful access thereto or the opportunity to play the game as described herein.

The various aspects, embodiments, implementations or features of the described embodiments can be used separately or in any combination. Various aspects of the described embodiments can be implemented by software, hardware or a combination of hardware and software. Computer readable medium can be any data storage device that can store data which can thereafter be read by a computer system. Examples of computer readable medium include read-only memory, random-access memory, CD-ROMs, DVDs, magnetic tape, optical data storage devices, and carrier waves. The computer readable medium can also be distributed over network-coupled computer systems so that the computer readable code is stored and executed in a distributed fashion.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. An automated playing card retrieval system adapted for use with a physical gaming table adapted to host live wager-based table games, the automated playing card retrieval system comprising:

a movable receiving component adapted to receive a plurality of physical playing cards while or after at least one of the plurality of physical playing cards are dealt for the play of a live wager-based table game at a physical gaming table, wherein said movable receiving component is further adapted to display at least one of the plurality of physical playing cards to one or more players seated away from the physical gaming table during the play of the live wager-based table game; and an automated card removal component adapted to facilitate the removal of the plurality of physical playing cards received from the movable receiving component when the moving receiving component is in a discard position to a discard region after the play of the live wager-based table game involving the plurality of physical playing cards, wherein the one or more physical playing cards are dealt by a robotic manipulator mechanism.

2. The automated playing card retrieval system of claim 1, wherein said movable receiving component comprises a mechanized tray.

3. The automated playing card retrieval system of claim 1, wherein said movable receiving component is adapted to receive the plurality of physical playing cards at a first position, and wherein said receiving component is further adapted to be moved to a second position where the plurality of physical playing cards are removed to the discard region.

4. The automated playing card retrieval system of claim 3, wherein said movable receiving component is further adapted to display the at least one of the plurality of physical playing cards at a third position that is separate from the first and second positions.

5. The automated playing card retrieval system of claim 4, wherein the display of the at least one of the plurality of physical playing cards is facilitated by the third position of said movable receiving component resulting in the at least one of the plurality of physical playing cards being elevated from and held at a substantially non-parallel angle to the surface of the physical gaming table.

6. The automated playing card retrieval system of claim 1, wherein the display of the at least one of the plurality of physical playing cards is facilitated by the use of a camera adapted to send images or video of the at least one of the plurality of physical playing cards to one or more remotely located gaming terminals.

7. The automated playing card retrieval system of claim 1, wherein said automated card removal component is adapted to manipulate said movable receiving component such that the plurality of physical playing cards are removed therefrom.

8. The automated playing card retrieval system of claim 1, wherein the plurality of physical playing cards are all of the playing cards used for the play of the live wager-based table game.

9. The automated playing card retrieval system of claim 1, further including: an automated card return component adapted to facilitate the return of the one or more physical playing cards from the discard region to another location where the one or more physical playing cards can be processed for the play of a future live wager-based table game at the physical gaming table.

10. The automated playing card retrieval system of claim 9, wherein the one or more physical playing cards are dealt from a card shoe at the physical gaming table, and wherein said automated card return component is further adapted to facilitate the return of the one or more physical playing cards to the card shoe.

11. The automated playing card retrieval system of claim 10, wherein the one or more physical playing cards are processed by an automatic card shuffler before being returned to the card shoe.

12. The automated playing card retrieval system of claim 9, wherein said automated card return component includes a conveyor.

13. An automated playing card retrieval system adapted for use with a physical gaming table adapted to host live wager-based table games, the automated playing card retrieval system comprising:

a movable receiving component configured to move between at least a first position and a second position and adapted to receive a plurality of physical playing cards while or after at least one of the plurality of physical playing cards are dealt for the play of a live wager-based table game at a physical gaming table, wherein said movable receiving component is further adapted to display at least one of the plurality of physical playing cards to one or more players seated away from the physical gaming table during the play of the live wager-based table game; and an automated card removal component adapted to facilitate the removal of the plurality of physical playing cards from the movable receiving component to a discard region after the play of the live wager-based table game involving the plurality of physical playing cards, wherein the one or more physical playing cards are dealt by a robotic manipulator mechanism, and wherein automated card return component comprises an air blower or vacuum component.

14. An automated playing card retrieval system adapted for use with a physical gaming table adapted to host live wager-based table games, the automated playing card retrieval system comprising:

a movable receiving component configured to move between at least a first position and a second position and adapted to receive a plurality of physical playing cards while or after at least one of the plurality of physical playing cards are dealt for the play of a live wager-based table game at a physical gaming table, wherein said movable receiving component is further adapted to display at least one of the plurality of physical playing cards to one or more players seated away from the physical gaming table during the play of the live wager-based table game; and an automated card removal component adapted to facilitate the removal of the plurality of physical playing cards from the movable receiving component to a discard region after the play of the live wager-based table game involving the plurality of physical playing cards, wherein the one or more physical playing cards are dealt by a robotic manipulator mechanism, and wherein at least a portion of said automated card return component vibrates to facilitate movement of the one or more physical playing cards.

15. An automated playing card dealing and retrieval system, comprising:

a robotic manipulator mechanism adapted to deal a plurality of physical gaming cards at a physical gaming table adapted to host live wager-based table games involving wagers, live game play based on the wagers, and monetary awards based on the results of the live game play;

a movable receiving component adapted to receive one or more of the plurality of physical playing cards while or after the one or more physical playing cards are dealt by said robotic manipulator mechanism for the play of a live wager-based table game at the physical gaming table, wherein said movable receiving component is further adapted to display at least one of the one or more physical playing cards to one or more players seated away from the physical gaming table during the play of the live wager-based table game;

an automated card removal component adapted to facilitate the removal of the one or more physical playing cards received from the movable receiving component when the moving receiving component is in a discard position to a discard region after the play of the live wager-based table game involving the one or more physical playing cards; and an automated card return component adapted to facilitate the return of the one or more physical playing cards from the discard region to another location where the one or more physical playing cards can be processed for the play of a future live wager-based table game at the physical gaming table.

16. The automated playing card dealing and retrieval system of claim 15, further including:

a card shoe from which the plurality of physical playing cards are dealt; and an automatic card shuffler adapted to process the one or more physical playing cards after they are returned from the automated card return component and before they are provided to the card shoe.

17. The automated playing card dealing and retrieval system of claim 16, wherein the display of the at least one of the one or more physical playing cards is facilitated by the use of a camera adapted to stream images or video of the at least one of the one or more physical playing cards to one or more remotely located gaming terminals.

18. The automated playing card dealing and retrieval system of claim 16, further including:

the physical gaming table.

19. The automated playing card dealing and retrieval system of claim 15, wherein said movable receiving component comprises a mechanized tray that is adapted to receive the one or more physical playing cards at a first position, wherein said mechanized tray is further adapted to be moved to a second position where the one or more physical playing cards are removed to the discard region, wherein said mechanized tray is further adapted to display the at least one of the one or more physical playing cards at a third position that is separate from the first and second positions, and wherein the display of the at least one of the one or more physical playing cards is facilitated by the third position of said mechanized tray resulting in the at least one of the one or more physical playing cards being elevated from and held at a substantially non-parallel angle to the surface of the physical gaming table.

* * * * *